US008798504B2

(12) United States Patent
Shiba et al.

(10) Patent No.: US 8,798,504 B2
(45) Date of Patent: Aug. 5, 2014

(54) IMAGE FORMING APPARATUS

(75) Inventors: Hiroki Shiba, Kanagawa (JP); Osamu Iida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 211 days.

(21) Appl. No.: 13/366,054

(22) Filed: Feb. 3, 2012

(65) Prior Publication Data

US 2013/0064572 A1 Mar. 14, 2013

(30) Foreign Application Priority Data

Sep. 8, 2011 (JP) ..... 2011-196383

(51) Int. Cl.
*G03G 15/08* (2006.01)

(52) U.S. Cl.
USPC ..... 399/121; 399/101; 399/111; 399/110; 399/328; 399/329

(58) Field of Classification Search
USPC ..... 399/121, 101, 11, 114, 110, 328, 329
See application file for complete search history.

(56) References Cited

U.S. PATENT DOCUMENTS

2011/0116831 A1* 5/2011 Honobe et al. ..... 399/110

FOREIGN PATENT DOCUMENTS

JP 2004-117988 A 4/2004
JP 2006-220993 A 8/2006

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An image forming apparatus includes a rotatable image carrier, a detachable transfer body on which an image is transferred, a contact and separation mechanism that moves the transfer body into contact with and away from the image carrier, and a coupling member to be coupled to the contact and separation mechanism. When the coupling member is turned forward to a first turn position in a coupled state coupled to the contact and separation mechanism, the contact and separation mechanism contacts the transfer body with the image carrier, and when the coupling member is turned in reverse from the first turn position to a second turn position in the coupled state, the contact and separation mechanism separates the transfer body from the image carrier and the coupling member withdraws in a direction opposite a direction to couple the coupling member to the contact and separation mechanism.

5 Claims, 28 Drawing Sheets

IMAGE FORMING APPARATUS

CROSS-REFERENCE TO RELATED APPLICATIONS

This application is based on and claims priority under 35 USC 119 from Japanese Patent Application No. 2011-196383 filed Sep. 8, 2011.

BACKGROUND

Technical Field

The present invention relates to an image forming apparatus.

SUMMARY

According to an aspect of the invention, there is provided an image forming apparatus including an image carrier rotatably provided in an apparatus body to carry an image, a transfer body on which the image carried by the image carrier is transferred, the transfer body being provided in the apparatus body such as to be detachable in an orthogonal direction orthogonal to a rotation axis direction of the image carrier, a contact and separation mechanism provided in the transfer body to move the transfer body into contact with and away from the image carrier, and a coupling member provided in the apparatus body to be coupled to the contact and separation mechanism in the rotation axis direction of the image carrier. When the coupling member is turned forward to a first turn position in a coupled state coupled to the contact and separation mechanism, the contact and separation mechanism brings the transfer body into contact with the image carrier, and when the coupling member is turned in reverse from the first turn position to a second turn position in the coupled state, the contact and separation mechanism separates the transfer body from the image carrier and the coupling member is withdrawn at the second turn position in an opposite direction opposite a coupling direction in which the coupling member is coupled to the contact and separation mechanism so as to allow detachment of the transfer body.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below with reference to the drawings.

Configuration of Image Forming Apparatus of Exemplary Embodiment

Figure 1:
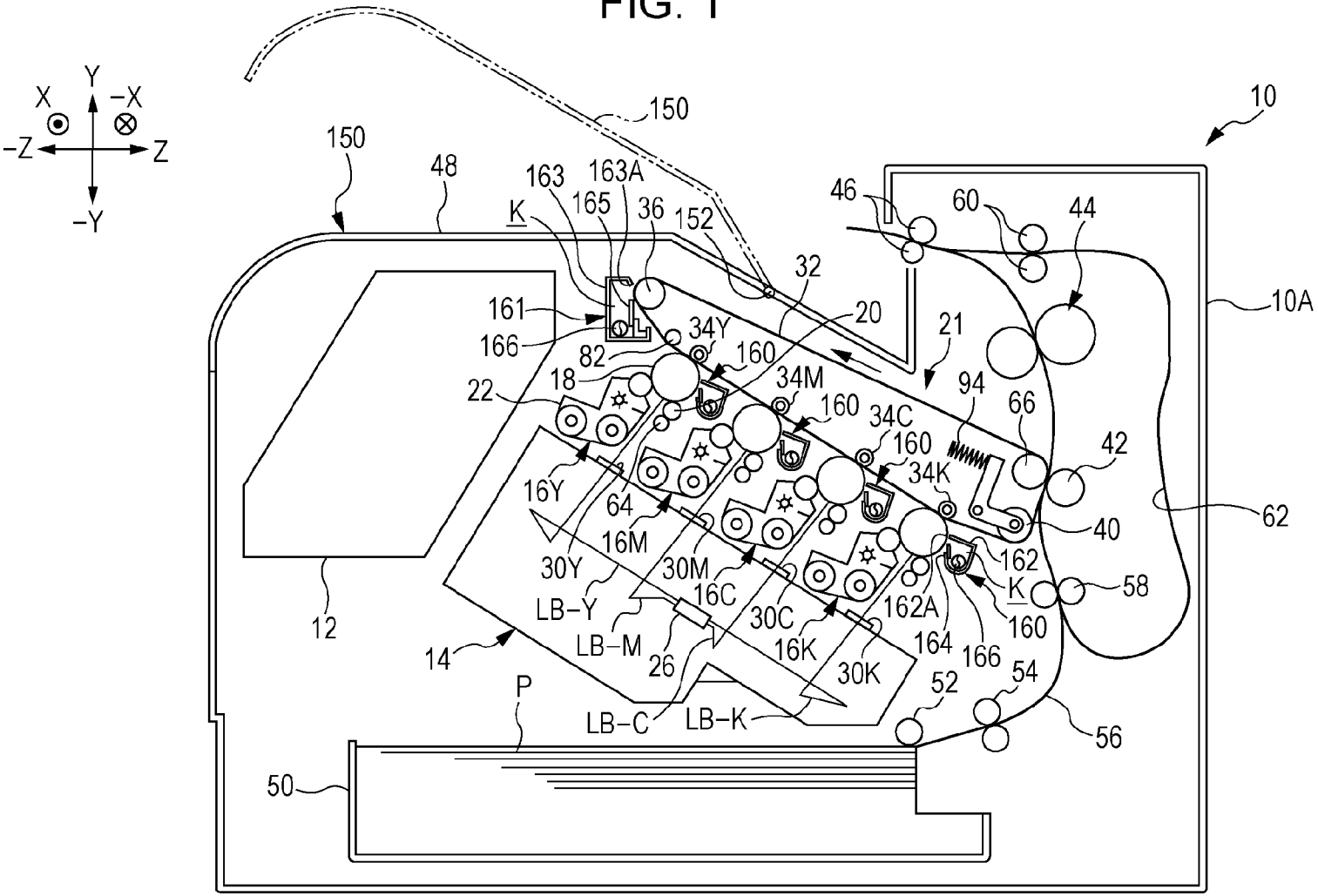
FIG. 1 is a schematic view illustrating a configuration of an image forming apparatus according to an exemplary embodiment.

First, a configuration of an image forming apparatus 10 according to the exemplary embodiment will be described. FIG. 1 is a schematic view illustrating the configuration of the image forming apparatus 10 of the exemplary embodiment. An X-direction, a −X direction, a Y-direction (upward direction), a −Y-direction (downward direction), a Z-direction, and a −Z-direction described below are directions of arrows in the drawings. In each of the drawings, an encircled cross represents an arrow pointing from the front side of the paper of the drawing to the back side, and an encircled dot represents an arrow pointing from the back side of the plane of the drawing to the front side.

As illustrated in FIG. 1, an image processing unit 12 for conducting image processing on input image data is provided in an apparatus body 10A of the image forming apparatus 10. The image processing unit 12 processes input image data into gradation data of four colors of yellow (Y), magenta (M), cyan (C), and black (K). According to the processed gradation data, an exposure device 14 provided in the center of the apparatus body 10A performs image exposure with laser light beams LB.

Above the exposure device 14 (on a Y-direction side), four image forming units 16Y, 16M, 16C, and 16K corresponding to yellow (Y), magenta (M), cyan (C), and black (K) are arranged at intervals in a direction inclined with respect to a horizontal direction (−Z-direction, Z-direction). When there is no need to distinguish among the colors Y, M, C, and K, the letters Y, M, C, and K are sometimes omitted.

These four image forming units 16Y, 16M, 16C, and 16K have a similar structure. Each of the image forming units 16Y, 16M, 16C, and 16K includes an image carrier 18, a charging member 20, a developing member 22, and a removing device 160. The image carrier 18 is rotatably provided in the apparatus body 10A to carry an image thereon. The charging member 20 charges an outer peripheral surface of the image carrier 18. The developing member 22 develops an electrostatic latent image, which is formed on the charged outer peripheral surface of the image carrier 18 by image exposure with the exposure device 14, with toner of a predetermined color into a visible toner image. The removing device 160 removes residual toner remaining on the outer peripheral surface of the image carrier 18. A specific structure of the removing device 160 will be described below.

The image carrier 18 is rotated at a predetermined speed. The charging member 20, the developing member 22, and the removing device 160 are arranged in this order in a rotating direction of the image carrier 18. On a lower side of the charging member 20, a cleaning member 64 is provided to clean the outer peripheral surface of the charging member 20 by contact therewith.

The exposure device 14 includes four semiconductor lasers (not illustrated) corresponding to the image forming units 16Y, 16M, 16C, and 16K. The semiconductor lasers emit laser light beams LB-Y, LB-M, LB-C, and LB-K according to gradation data.

The laser light beams LB-Y, LB-M, LB-C, and LB-K emitted from the semiconductor lasers are applied onto a polygonal mirror 26 serving as a rotating polygonal mirror through an unillustrated cylindrical lens, and are deflectively scanned by the polygonal mirror 26. The laser light beams LB-Y, LB-M, LB-C, and LB-K deflectively scanned by the polygonal mirror 26 are scanned to expose an exposure point on the image carrier 18 from an obliquely lower side through an unillustrated imaging lens, unillustrated plural mirrors, and glass windows 30Y, 30M, 30C, and 30K.

A first transfer unit 21 serving as an example of a transfer device is provided above the image forming units 16Y, 16M, 16C, and 16K (on a Y-direction side). The first transfer unit 21 includes an intermediate transfer belt 32, a driving roller 36, a tensioning roller 40, a driven roller 66, and first transfer rollers 34Y, 34M, 34C, and 34K. The intermediate transfer belt 32 serves as an example of a transfer body on which an image carried on the image carrier 18 is transferred. The intermediate transfer belt 32 is wound on the driving roller 36. The driving roller 36 rotates to circle the intermediate transfer belt 32 in a direction of arrow (a counterclockwise direction in FIG. 1). The intermediate transfer belt 32 is also wound on the tensioning roller 40. The tensioning roller 40 serves as an example of a tensioning member that applies tension to the intermediate transfer belt 32. The driven roller 66 is provided above the tensioning roller 40, and is rotated along with the rotation of the intermediate transfer belt 32. The first transfer rollers 34Y, 34M, 34C, and 34K serve as an example of a transfer member, and are provided on a side of the intermediate transfer belt 32 opposite the image carriers 18Y, 18M, 18C, and 18K.

The four first transfer rollers 34Y, 34M, 34C, and 34K multiply transfer toner images of yellow (Y), magenta (M), cyan (C), and black (K) formed on the image carriers 18 in the image forming units 16Y, 16M, 16C, and 16K onto the intermediate transfer belt 32.

In the first transfer unit 21, a removing device 161 for removing residual toner remaining on an outer peripheral surface of the intermediate transfer belt 32 is provided on a side of the intermediate transfer belt 32 opposite the driving roller 36. Specific structures of the first transfer unit 21 and the removing device 161 will be described below.

A second transfer roller 42 is provided on a side of the intermediate transfer belt 32 opposite the driven roller 66. The toner images of yellow (Y), magenta (M), cyan (C), and black (K) multiply transferred on the intermediate transfer belt 32 are transported by the intermediate transfer belt 32, are nipped between the driven roller 66 and the second transfer roller 42, and are secondarily transferred onto a sheet material P serving as a recording medium transported along a sheet transport path 56.

A fixing device 44 is provided on a downstream side of the second transfer roller 42 in a transport direction of the sheet material P (hereinafter simply referred to as a downstream side). The fixing device 44 fixes the transferred toner images on the sheet material P with heat and pressure.

On a downstream side of the fixing device 44, output rollers 46 are provided to output the sheet material P, on which the toner images are fixed, into an output portion 48 provided at the top of the apparatus body 10A of the image forming apparatus 10.

A paper feed member 50 is provided at the bottom of the apparatus body 10A of the image forming apparatus 10, and sheet materials P are stacked in the paper feed member 50. A paper feed roller 52 is also provided to feed the sheet materials P stacked in the paper feed member 50 into the sheet transport path 56. Separation rollers 54 are provided on a downstream side of the paper feed roller 52 to separate and transport the sheet materials P one by one. Registration rollers 58 are provided on a downstream side of the separation rollers 54 to determine transport timing. With this structure, a sheet material P supplied from the paper feed member 50 is supplied to a contact position between the intermediate transfer belt 32 and the second transfer roller 42 (second transfer position) by the registration rollers 58 at a predetermined timing.

Transport rollers 60 are provided next to the output rollers 46 (on a Z-direction side). The transport rollers 60 transport a sheet material P, on which a toner image is fixed on one surface by the fixing device 44, to a duplex transport path 62 without simply outputting the sheet material P onto the output portion 48 with the output rollers 46. Thus, the sheet material P transported along the duplex transport path 62 is transported to the registration rollers 58 again while being turned upside down, and is output onto the output portion 48 after a toner image is transferred and fixed on a back surface thereof.

With the above-described structure, an image is formed on a sheet material P as follows.

First, color gradation data are sequentially output from the image processing unit 12 to the exposure device 14, and the exposure device 14 emits laser light beams LB-Y, LB-M, LB-C, and LB-K according to the gradation data. The laser light beams LB-Y, LB-M, LB-C, and LB-K are scanned to expose the outer peripheral surfaces of the image carriers 18 charged by the charging members 20, so that electrostatic latent images are formed on the outer peripheral surfaces of the image carriers 18. The electrostatic latent images formed on the image carriers 18 are developed into visible toner images of yellow (Y), magenta (M), cyan (C), and black (K) by the developing members 22Y, 22M, 22C, and 22K, respectively.

The toner images of yellow (Y), magenta (M), cyan (C), and black (K) formed on the image carriers 18 are multiply transferred onto the circling intermediate transfer belt 32 by the first transfer rollers 34 in the first transfer unit 21 located above the image forming units 16Y, 16M, 16C, and 16K.

The color toner images multiply transferred on the circling intermediate transfer belt 32 are secondarily transferred by the second transfer roller 42 onto a sheet material P that is transported to the sheet transport path 56 at a predetermined timing from the paper feed member 50 by the paper feed roller 52, the separation rollers 54, and the registration rollers 58.

The sheet material P on which the toner images are transferred is further transported to the fixing device 44. The transferred toner images are fixed on the sheet material P by the fixing device 44, and the sheet material P is then output by the output rollers 46 onto the output portion 48 provided at the top of the apparatus body 10A of the image forming apparatus 10.

When images are to be formed on both surfaces of the sheet material P, after toner images are fixed on one surface of the sheet material P by the fixing device 44, the sheet material P is not output to the output portion 48, but is led into the duplex transport path 62 by the output rollers 46. When the sheet material P is transported along the duplex transport path 62, it is turned upside down, and is transported to the registration rollers 58 again. Then, toner images are transferred and fixed onto a back surface of the sheet material P, and the sheet material P is output to the output portion 48 by the output rollers 46.

Specific Structure of First Transfer Unit 21

Next, a specific structure of the first transfer unit 21 will be described.

In the first transfer unit 21 of the exemplary embodiment, the first transfer rollers 34 for transferring color toner images from the image carriers 18 onto the intermediate transfer belt 32 are formed of metal (e.g., stainless steel).

Figure 2:
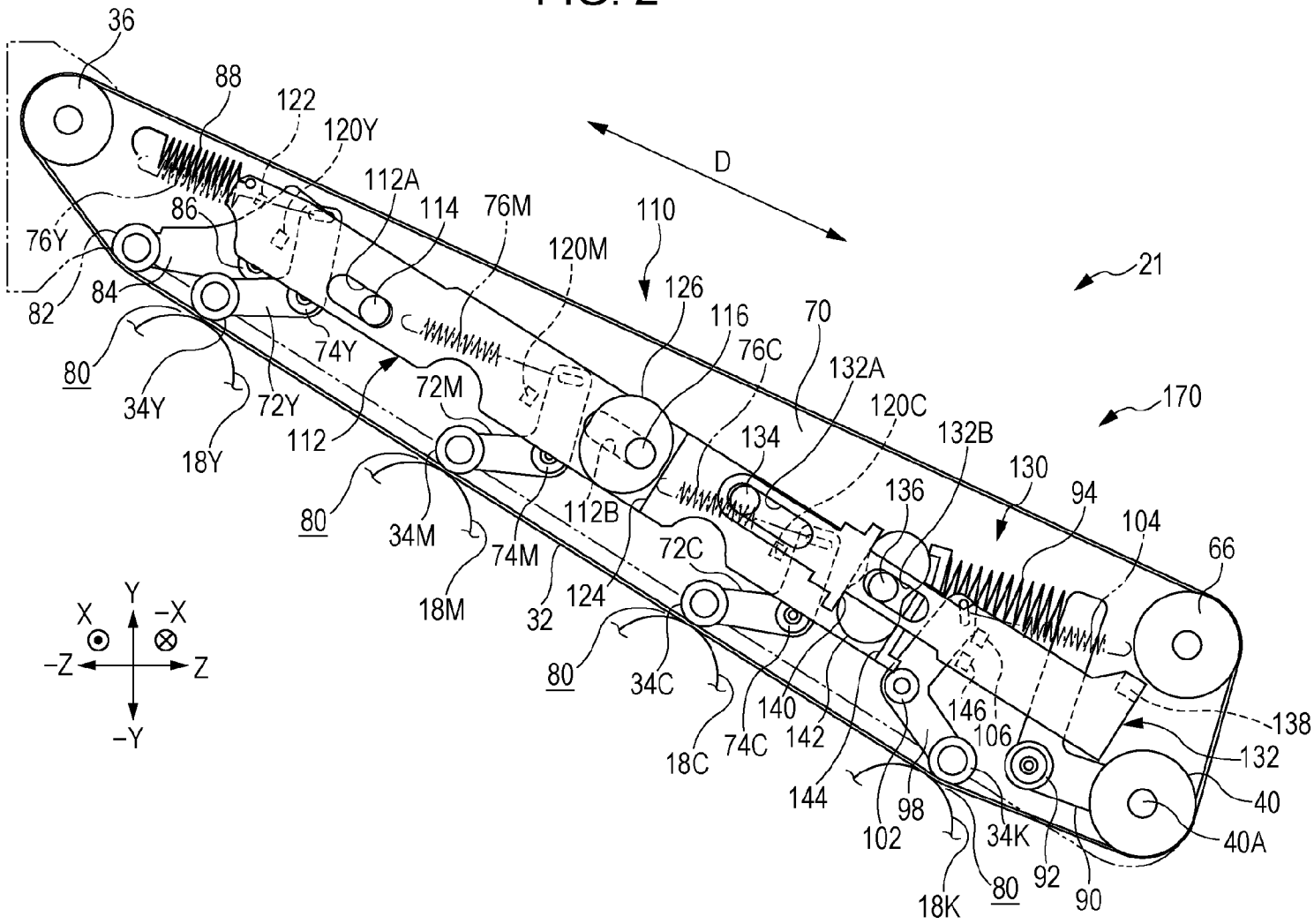
FIG. 2 is a side view of a first transfer unit in the exemplary embodiment.
Figure 6:
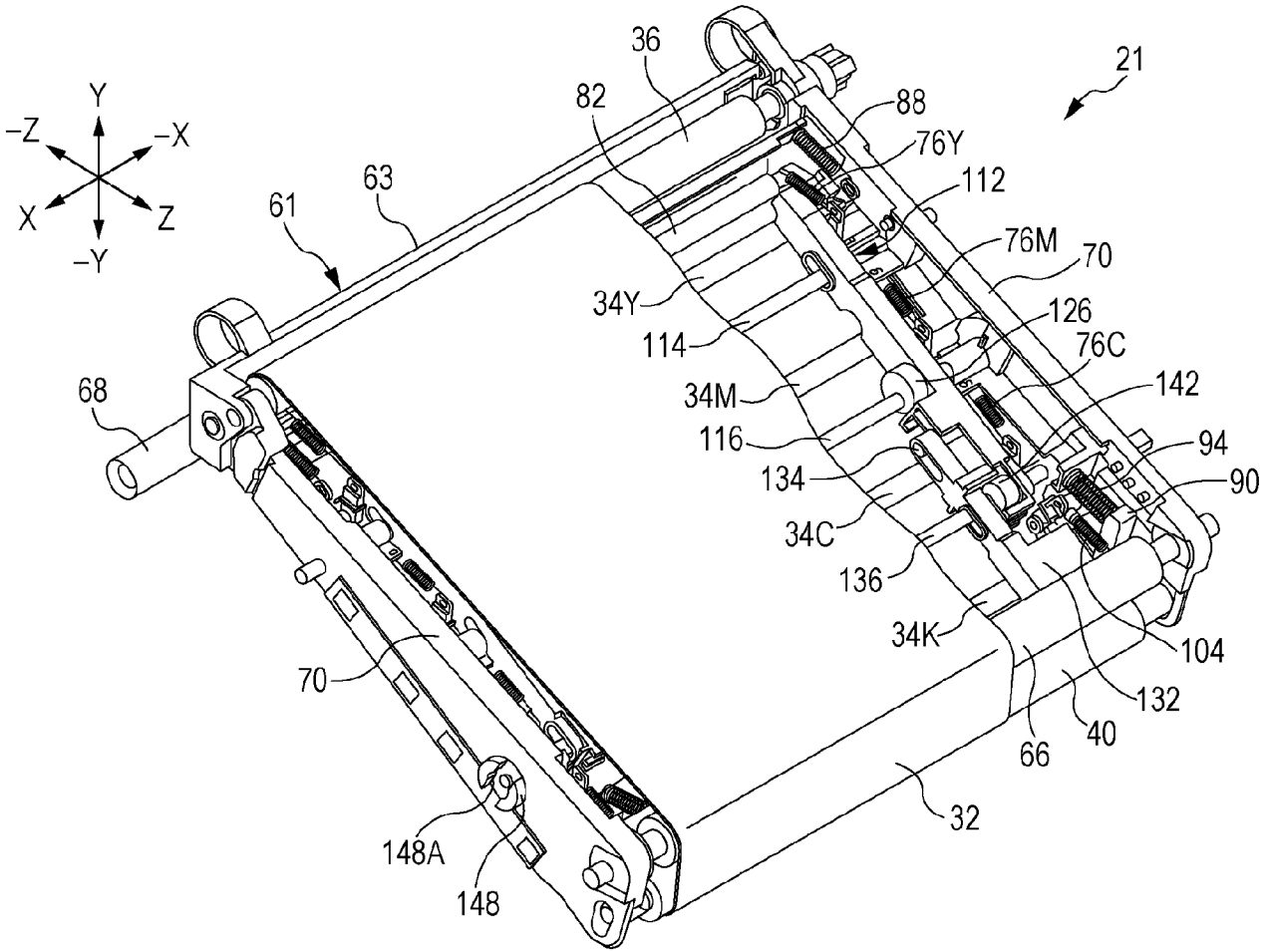
FIG. 6 is a perspective view of the first transfer unit.

As illustrated in FIGS. 2 and 6, when color toner images are to be multiply transferred onto the intermediate transfer belt 32 (color printing), the first transfer rollers 34 provided in the first transfer unit 21 press the intermediate transfer belt 32 against the image carriers 18, so that color toner images formed on the image carriers 18 are transferred onto the intermediate transfer belt 32.

On both sides of each of the first transfer rollers 34 in a rotation axis direction (X-direction, −X-direction (hereinafter simply referred to as an axial direction)), a pair of frame members 70 are provided to form a framework of the first transfer unit 21.

As illustrated in FIG. 2, the first transfer rollers 34Y, 34M, and 34C are rotatably attached at both ends to distal ends of support members 72Y, 72M, and 72C, respectively. The support members 72Y, 72M, and 72C serve as an example of a first support member, and are bent at the center into an inverted-L shape, as viewed in the axial direction. Also, the bent portions of the support members 72Y, 72M, and 72C are provided with turn shafts 74Y, 74M, and 74C. The turn shafts 74Y, 74M, and 74C allow the support members 72 to be turnably attached to the frame members 70. The turn shafts 74Y, 74M, and 74C extend in the axial direction.

To the other ends of the support members 72Y, 72M, and 72C, coil springs 76Y, 76M, and 76C serving as an example of a biasing member are attached, respectively. The coil springs 76Y, 76M, and 76C bias the first transfer rollers 34Y, 34M, and 34C toward a back surface of the intermediate transfer belt 32. More specifically, the coil springs 76Y, 76M, and 76C are fixed at one end to the other ends of the support members 72Y, 72M, and 72C, and are fixed at the other end to the frame members 70.

Between the driving roller 36 and the first transfer roller 34Y, a regulation roller 82 is provided as an example of a regulation member. The regulation roller 82 supports the back surface of the intermediate transfer belt 32, and regulates a circling path of the intermediate transfer belt 32 at transfer portions 80 where color toner images are transferred onto the intermediate transfer belt 32.

Both ends of the regulation roller 82 are rotatably attached to distal ends of support members 84 bent at the center into an inverted-L shape, as viewed in the axial direction. At the bent portions of the support members 84, a turn shaft 86 extending in the axial direction is provided to turnably attach the support members 84 to the frame members 70.

At the other ends of the support members 84, coil springs 88 are provided as an example of a biasing member so as to bias the regulation roller 82 toward the back surface of the intermediate transfer belt 32. More specifically, the coil springs 88 are fixed at one end to the other ends of the support members 84, and are fixed at the other end to the frame members 70. The biasing force of the coil springs 88 is set to be larger than the biasing force of the above-described coil springs 76. The first transfer rollers 34Y, 34M, and 34C press the intermediate transfer belt 32 against the image carriers 18.

The frame members 70 have projections (not illustrated) that determine the positions of the support members 84 by contact with the support members 84 to which the biasing force of the coil springs 88 is transmitted. In this way, since the support members 84 are contacted with the projections by the biasing force of the coil springs 88, the position of the regulation roller 82 is determined.

Both ends of a rotation shaft 40A of the tensioning roller 40 for tensioning the intermediate transfer belt 32 are rotatably supported by ends of holding members 90 that are bent at the center into an L-shape, as viewed in the axial direction. At the bent portions of the holding members 90, a turn shaft 92 extending in the axial direction is provided to turnably attach the holding members 90 to the frame members 70. That is, the holding members 90 turn about the turn shaft 92, and the tensioning roller 40 moves around the turn shaft 92 along an arc-shaped path.

To the other ends (upward pointing ends) of the holding members 90, distal ends of coil springs 94 serving as an example of a biasing member are fixed. Proximal ends of the coil springs 94 are fixed to the frame members 70. The coil springs 94 bias the other ends of the holding members 90 so that the holding members 90 turn about the turn shaft 92 and the tensioning roller 40 presses the back surface (inner peripheral surface) of the intermediate transfer belt 32. Thus, a predetermined range of tension is applied to the intermediate transfer belt 32.

The first transfer roller 34K is provided between the tensioning roller 40 and the first transfer roller 34C. Both ends of the first transfer roller 34K are rotatably attached to distal ends of support members 98 serving as an example of a second support member. The support members 98 are bent at the center into an L-shape, as viewed in the axial direction. At the bent portions of the support members 98, a turn shaft 102 extending in the axial direction is provided to turnably attach the support members 98 to the frame members 70.

To the other ends of the support members 98, coil springs 104 are attached as an example of a biasing member. The coil springs 104 bias the first transfer roller 34K toward the back surface of the intermediate transfer belt 32. More specifically, the coil springs 104 are fixed at one end to the other ends of the support members 98, and are fixed at the other end to the frame members 70. The biasing force of the coil springs 104 is set to be larger than the biasing force of the above-described coil springs 76.

The frame members 70 have projections 106 that determine the positions of the support members 98 by contact with the support members 98 to which the biasing force of the coil springs 104 is transmitted. In this way, since the support members 98 are contacted with the projections 106 by the biasing force of the coil springs 104, the position of the first transfer roller 34K is determined.

Between the regulation roller 82 and the first transfer roller 34K, whose positions are determined, as described above, the circling path of the intermediate transfer belt 32 is regulated so that the intermediate transfer belt 32 passes through determined positions. That is, the circling path of the intermediate transfer belt 32 at the color transfer portions 80 is regulated by the regulation roller 82 and the first transfer roller 34K.

First switch mechanisms 110 are provided to switch from a multicolor transfer mode (multicolor transfer state) to a monochromatic transfer mode (monochromatic transfer state). In the multicolor transfer mode, the first transfer rollers 34Y, 34M, 34C, and 34K are in contact with the back surface of the intermediate transfer belt 32 so as to transfer toner images onto the front surface of the intermediate transfer belt 32. In the monochromatic transfer mode, the first transfer rollers 34Y, 34M, and 34C withdraw from the back surface of the intermediate transfer belt 32 and the first transfer rooler 34K transfers a toner image onto the front surface of the intermediate transfer belt 32.

Figure 3:
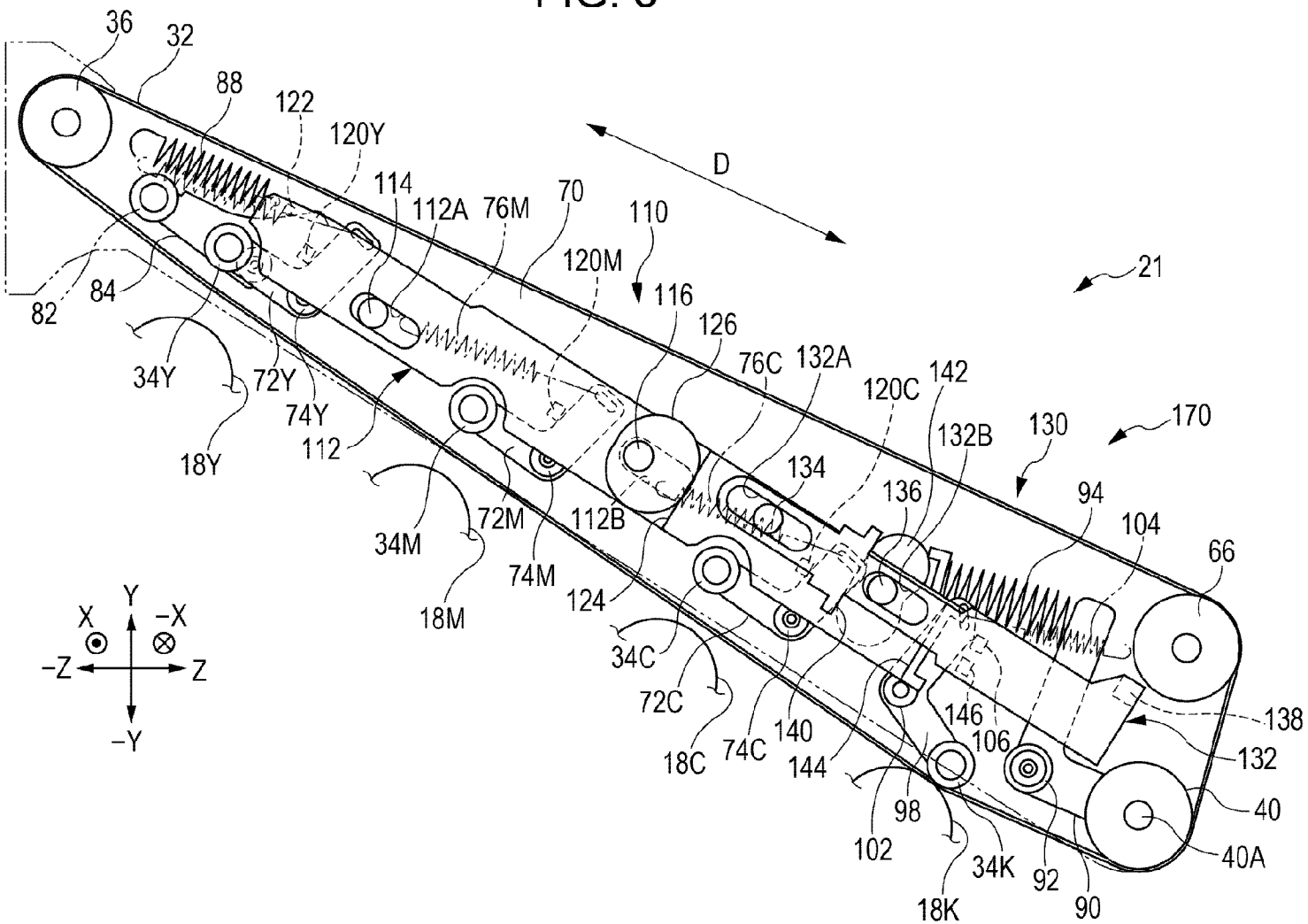
FIG. 3 is a side view of the first transfer unit.
Figure 7:
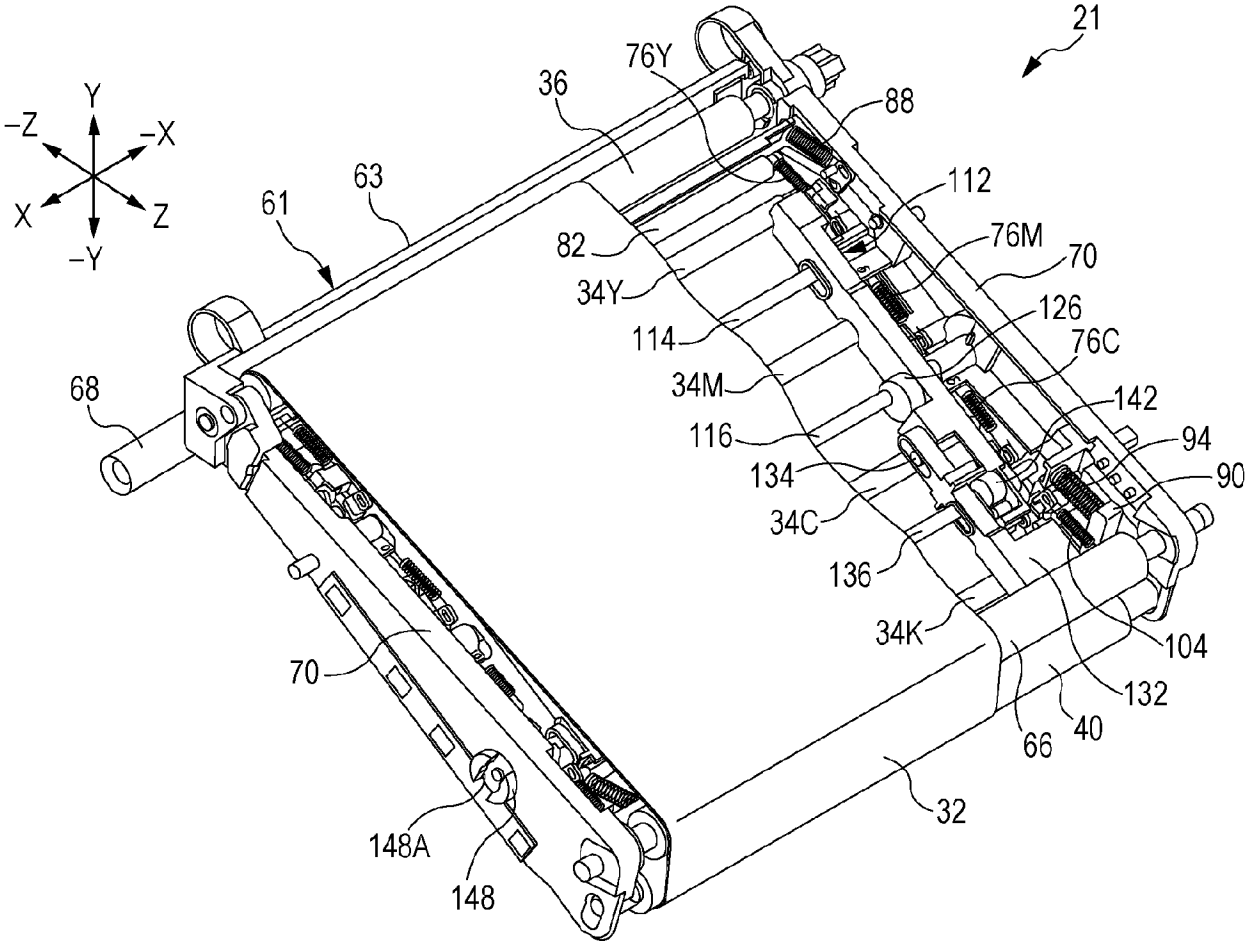
FIG. 7 is a perspective view of the first transfer unit.

As illustrated in FIGS. 2 and 3, the first switch mechanisms 110 include first moving members 112 that allow the regulation roller 82 and the first transfer rollers 34Y, 34M, and 34C to move between a first position in contact with the back surface of the intermediate transfer belt 32 (see FIGS. 2 and 6) and a second position withdrawn from the intermediate transfer belt 32 (see FIGS. 3 and 7).

More specifically, the first moving members 112 are provided on inner sides of the frame members 70 in the axial direction (sides where the first transfer rollers 34 are provided), and are each shaped like a plate extending in a first direction (a direction of arrow D in FIG. 2) in which the first transfer rollers 34 are arranged, as viewed in the axial direction. Further, the first moving members 112 have slots 112A and slots 112B extending in the first direction, as viewed in the axial direction. The slots 112A and the slots 112B are arranged in the first direction.

A columnar rod 114 extending through the slots 112A and a columnar rod 116 extending through the slots 112B are laid between the pair of frame members 70. The rod 114 and the rod 116 are movable in the slots 112A and the slots 112B, respectively. This allows the first moving members 112 to reciprocate in the first direction.

The first moving members 112 also include projections 122 and projections 120Y, 120M, and 120C. When the first moving members 112 move from one end to the other end, the projections 122 and the projections 120Y, 120M, and 120C come into contact with the support members 84 and the support members 72, thereby moving the regulation roller 82 and the first transfer rollers 34Y, 34M, and 34C from a first position (contact position (see FIG. 2)) to a second position (separate position (see FIG. 3)).

The first moving members 112 further include contact faces 124 serving as an example of a first contact portion. The contact faces 124 face toward the driving roller 36 in the first direction. Cam members 126 serving as an example of a first switch member come into contact with the contact faces 124 so as to move the regulation roller 82 and the first transfer rollers 34Y, 34M, and 34C from the first position (see FIG. 2) to the second position (see FIG. 3) via the first moving members 112.

More specifically, as illustrated in FIG. 2, the cam members 126 are attached to the rod 116. When short diameter sides of the cam members 126 oppose the contact faces 124, pressing force is not transmitted to the support members 84 and the support members 72 via the projections 122 and the projections 120, and the regulation roller 82 and the first transfer rollers 34Y, 34M, and 34C are placed at the first position by the biasing forces of the coil springs 88 and the coil springs 76.

In contrast, as illustrated in FIG. 3, when the rod 116 rotates and long diameter sides of the cam members 126 come into contact with the contact faces 124, the contact faces 124 are pressed by the cam members 126, and the first moving members 112 are moved toward the tensioning roller 40 in the first direction. When the first moving members 112 move in the first direction, pressing force is transmitted to the support members 84 and the support members 72 via the projections 122 and the projections 120. Then, the support members 84 and the support members 72 are turned about the turn shaft 86 and the turn shaft 74, respectively, and the regulation roller 82 and the first transfer rollers 34Y, 34M, and 34C are placed at the second position.

The rod 116 is rotated by driving force transmitted from an unillustrated external driving source that is driven according to instructions from a controller. When the pressing force of the first moving members 112 is released, the regulation roller 82 and the first transfer rollers 34Y, 34M, and 34C are moved from the second position to the first position by the biasing forces of the coil springs 88 and the coil springs 76.

On the other hand, second switch mechanisms 130 are provided to switch from the monochromatic transfer mode illustrated in FIG. 3 to a withdrawal mode (withdrawal state), in which the first transfer roller 34K is withdrawn from the back surface of the intermediate transfer belt 32 and all the first transfer rollers 34 are withdrawn from the intermediate transfer belt 32. The second switch mechanism 130 also switch from the multicolor transfer mode illustrated in FIG. 2 to the withdrawal mode in which all the first transfer rollers 34 are withdrawn from the intermediate transfer belt 32.

Figure 4:
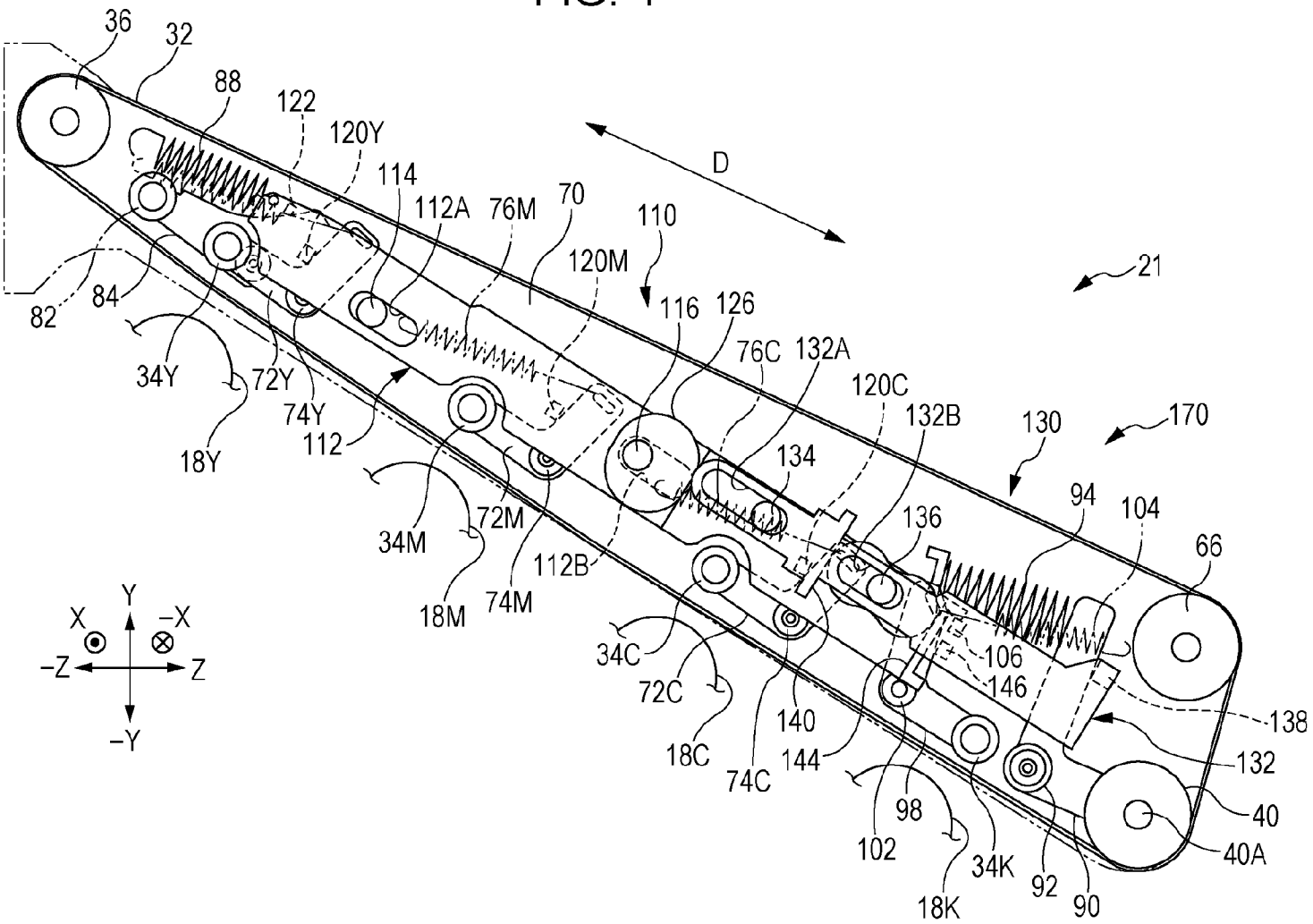
FIG. 4 is a side view of the first transfer unit.
Figure 5:
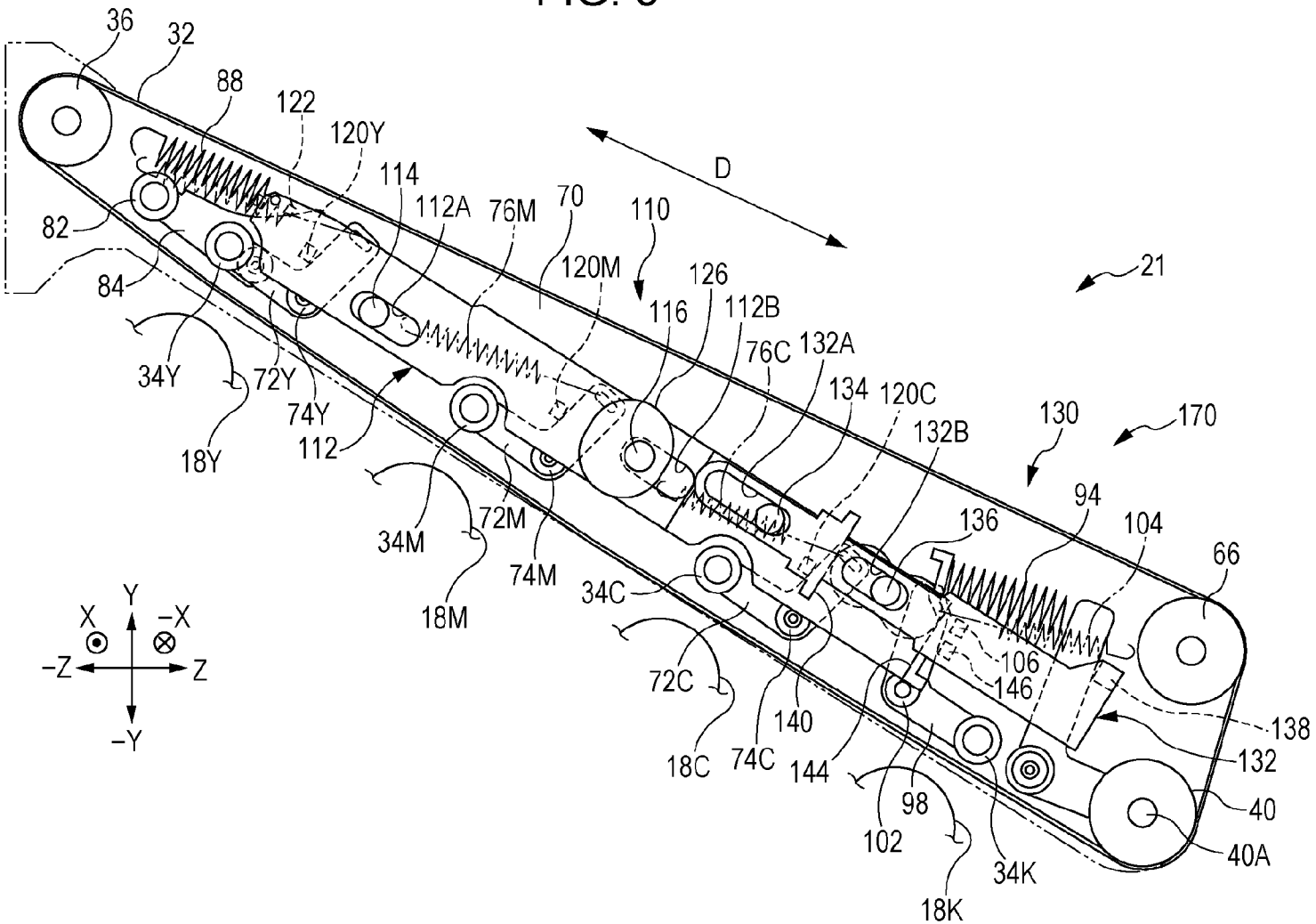
FIG. 5 is a side view of the first transfer unit.

As illustrated in FIGS. 2 and 3, the second switch mechanisms 130 include second moving members 132 that allow the first transfer roller 34K to move between a third position to support the back surface of the intermediate transfer belt 32 by contact therewith, and a fourth position withdrawn from the intermediate transfer belt 32 (see FIGS. 4, and 5).

More specifically, as illustrated in FIGS. 2 and 6, the second moving members 132 are provided on inner sides of the first moving members 112 in the axial direction, and extend in the first direction, as viewed in the axial direction. Further, the second moving members 132 have slots 132A and 132B extending in the first direction, as viewed in the axial direction, and the slots 132A and the slots 132B are arranged in the first direction.

The above-described first moving members 112 also have bosses 134 extending in the axial direction through the slots 132A. Further, a columnar rod 136 is laid between the pair of frame members 70 to extend through the slots 132B. The bosses 134 and the rod 136 are movable in the slots 132A and the slots 132B, respectively. This structure allows the second moving members 132 to reciprocate in the first direction.

As illustrated in FIGS. 2 and 4, the second moving members 132 also have projections 146 that contact with the support members 98 to move the first transfer roller 34K from the third position (see FIG. 2) to the fourth position (see FIG. 4) when the second moving members 132 move from one end toward the other end.

Similarly, the second moving members 132 have projections 138 that contact with the holding members 90 to turn the holding members 90 and to remove the tension applied to the intermediate transfer belt 32 by the tensioning roller 40 when the second moving members 132 move from one end toward the other end.

Further, the second moving members 132 have contact faces 140 serving as an example of a second contact portion facing toward the tensioning roller 40 in the first direction. Cam members 142 serving as an example of a second switch member contact with the contact faces 140 to move the first transfer roller 34K from the third position (see FIG. 2) to the fourth position (see FIG. 4) via the second moving members 132.

Figure 10:
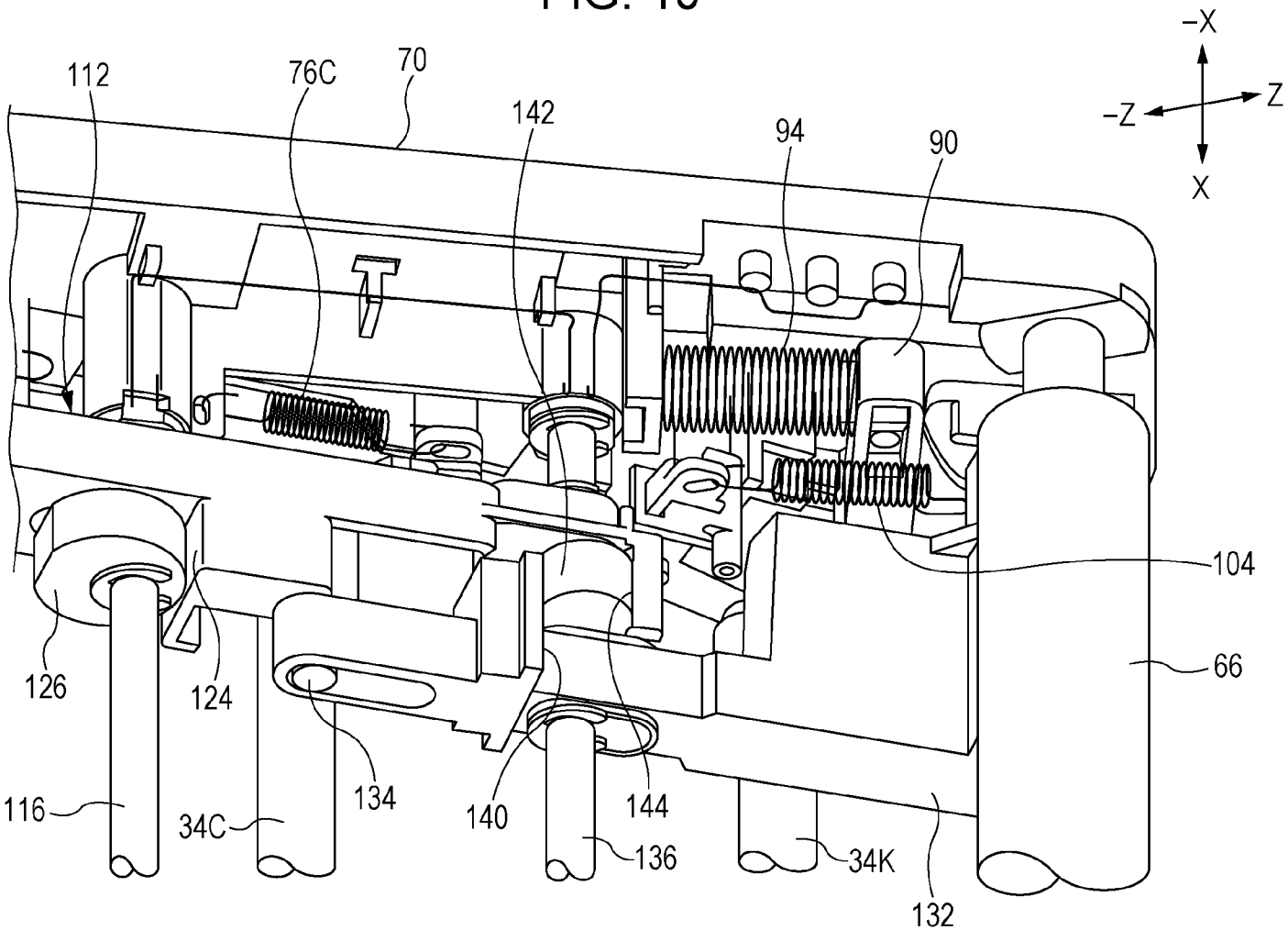
FIG. 10 is an enlarged perspective view of the first transfer unit.

More specifically, as illustrated in FIGS. 2 and 10, the cam members 142 are provided between the first moving members 112 and the second moving members 132 in the axial direction. The cam members 142 are attached to the rod 136. When short diameter sides of the cam members 142 oppose the contact faces 140, pressing force is not transmitted to the support members 98 and the holding members 90 via the projections 146 and the projections 138. The biasing force of the coil springs 104 places the first transfer roller 34K at the third position, and causes the tensioning roller 40 to apply tension to the intermediate transfer belt 32.

Figure 11:
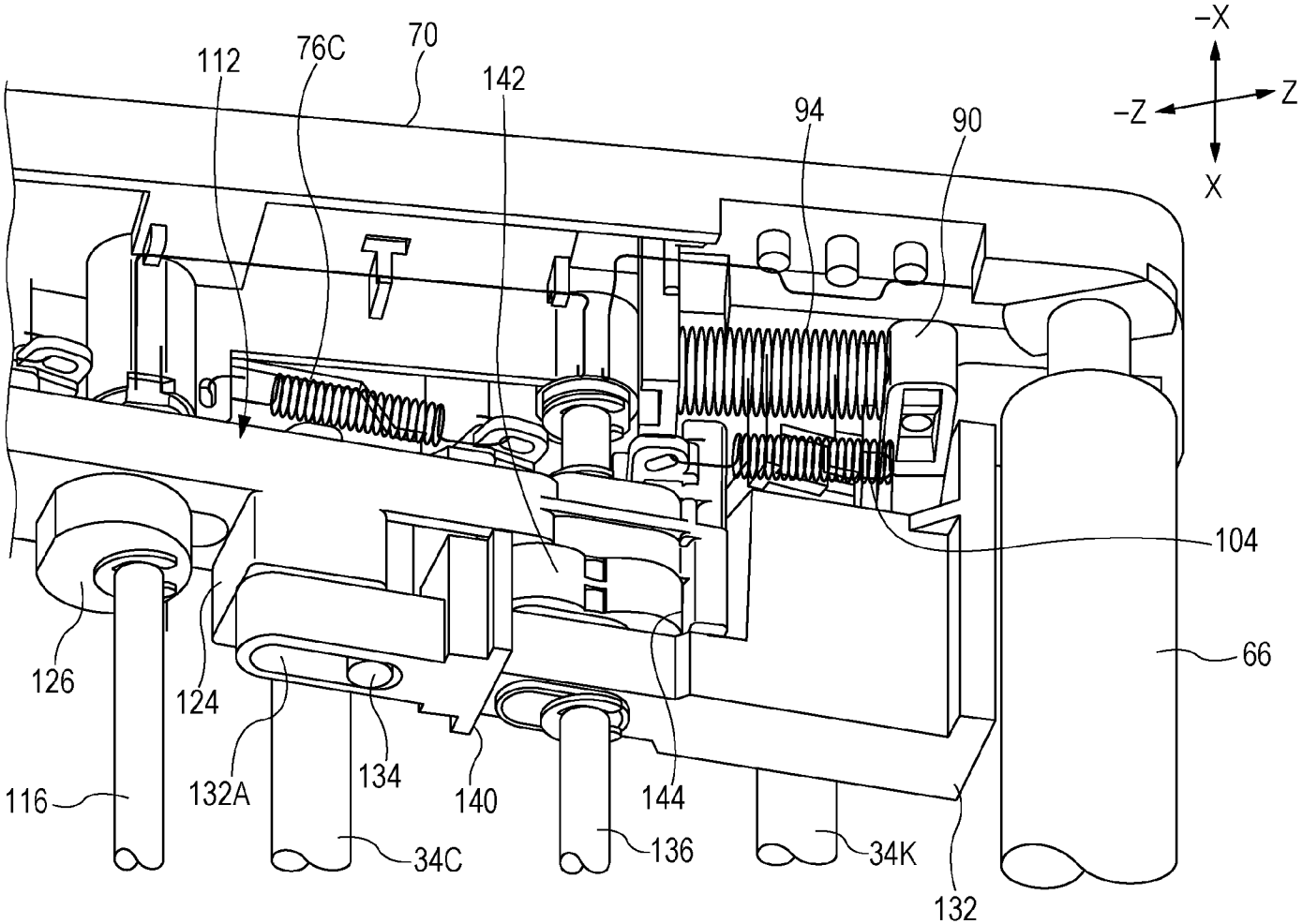
FIG. 11 is an enlarged perspective view of the first transfer unit.

In contrast, as illustrated in FIGS. 4 and 11, when the rod 136 rotates and long diameter sides of the cam members 142 come into contact with the contact faces 140, the contact faces 140 are pressed by the cam members 142, and the second moving members 132 move toward the driving roller 36 in the first direction. When the second moving members 132 move in the first direction, pressing force is transmitted to the support members 98 and the holding members 90 via the projections 146 and the projections 138. Then, the support members 98 turn about the turn shaft 102, the first transfer roller 34K is placed at the fourth position, and the holding members 90 turn about the turn shaft 92, so that tension applied to the intermediate transfer belt 32 is released.

As illustrated in FIG. 2, the first moving members 112 have contact faces 144 serving as an example of a third contact portion. The contact faces 144 are provided on sides of the cam members 142 opposite the contact faces 140, and face toward the driving roller 36. As illustrated in FIGS. 2 and 5, with this structure, in a case in which the first transfer rollers 34Y, 34M, and 34C are placed at the first position, when the rod 136 rotates and the long diameter sides of the cam members 142 come into contact with the contact faces 144, the regulation roller 82 and the first transfer rollers 34Y, 34M, and 34C move from the first position (see FIG. 2) to the second position (see FIG. 5).

As illustrated in FIG. 3, in a state in which the first transfer rollers 34Y, 34M, and 34C are at the second position and the first transfer roller 34K is at the third position, the cam members 142 are separate from the contact faces 144. Hence, even when the cam members 142 are turned, the first moving members 112 do not move.

As illustrated in FIG. 1, a cover portion 150 is provided at the top of the apparatus body 10A. The cover portion 150 opens the interior of the apparatus body 10A, and defines the output portion 48 when closed. More specifically, at one end of the cover portion 150, a turn shaft 152 extends in the X-direction of the apparatus body 10A. By turning the cover portion 150 about the turn shaft 152, the interior of the apparatus body 10A is opened upward. The first transfer unit 21 is provided in the apparatus body 10A such as to be detachable in a direction orthogonal to the rotation axis direction of the image carriers 18 (obliquely upward to the left in FIG. 1). In a state in which the cover portion 150 is open, the first transfer unit 21 is mounted in and demounted from the apparatus body 10A.

As illustrated in FIG. 6, a first coupling 148 (hereinafter referred to as a transfer-unit side coupling 148) is provided at one end of the rod 136. The transfer-unit side coupling 148 is fixed to the one end of the rod 136 to corotate with the rod 136. An X-direction side portion of the transfer-unit side coupling 148A has a recess 148A to be fitted on a below-described body side coupling 210.

In the exemplary embodiment, as described above, the regulation roller 82 and the first transfer rollers 34Y, 34M, 34C, and 34K withdraw from the intermediate transfer belt 32 so as to separate the intermediate transfer belt 32 from the image carriers 18 (see FIGS. 4 and 5). In a multicolor transfer mode, the regulation roller 82 and the first transfer rollers 34Y, 34M, 34C, and 34K contact with the intermediate transfer belt 32 so as to contact the intermediate transfer belt 32 with the image carriers 18 (see FIG. 2). Further, in a monochromatic transfer mode, as described above, the first transfer roller 34K contacts with the intermediate transfer belt 32 so as to contact the intermediate transfer belt 32 with the corresponding image carrier 18 (see FIG. 3). In this way, in the exemplary embodiment, the intermediate transfer belt 32 is moved into contact with and away from the image carriers 18.

In the exemplary embodiment, the transfer-unit side coupling 148, the rod 136, the cam members 142, the second moving members 132, the support members 98, the holding members 90, the first moving members 112, the support members 84, and the support members 72 corresponding to the colors constitute a contact and separation mechanism 170 that moves the intermediate transfer belt 32 into contact with and away from the image carriers 18.

Transmission Mechanism 200 for Transmitting Rotation Force to Rod 136 to Move Intermediate Transfer Belt 32 into Contact with and Away from Image Carriers 18

Next, a description will be given of a transmission mechanism 200 that transmits, to the rod 136, a rotation force for moving the intermediate transfer belt 32 into contact with and away from the image carriers 18.

Figure 12:
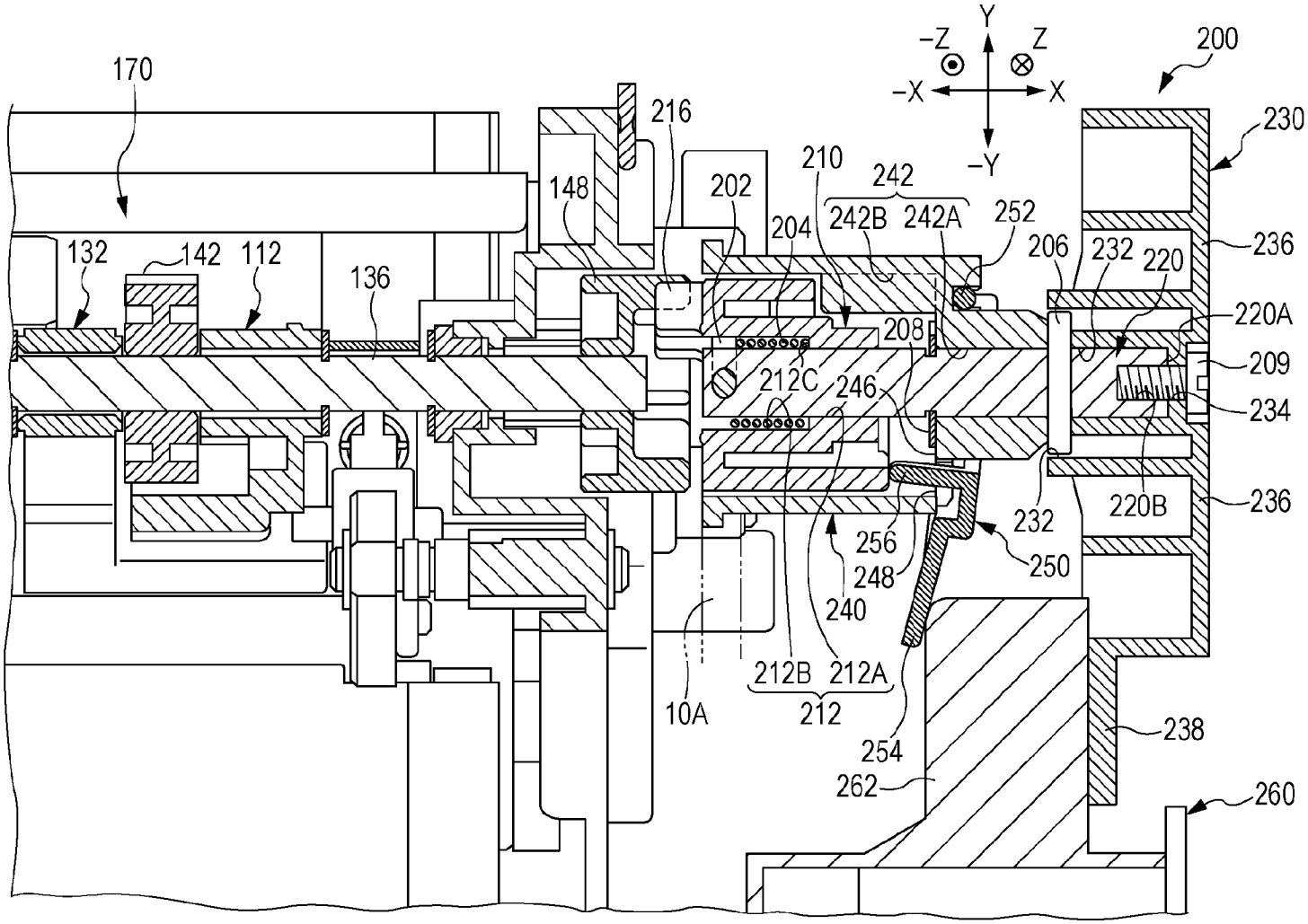
FIG. 12 is a partial cross-sectional view illustrating a structure of a transmission mechanism in the exemplary embodiment.
Figure 13:
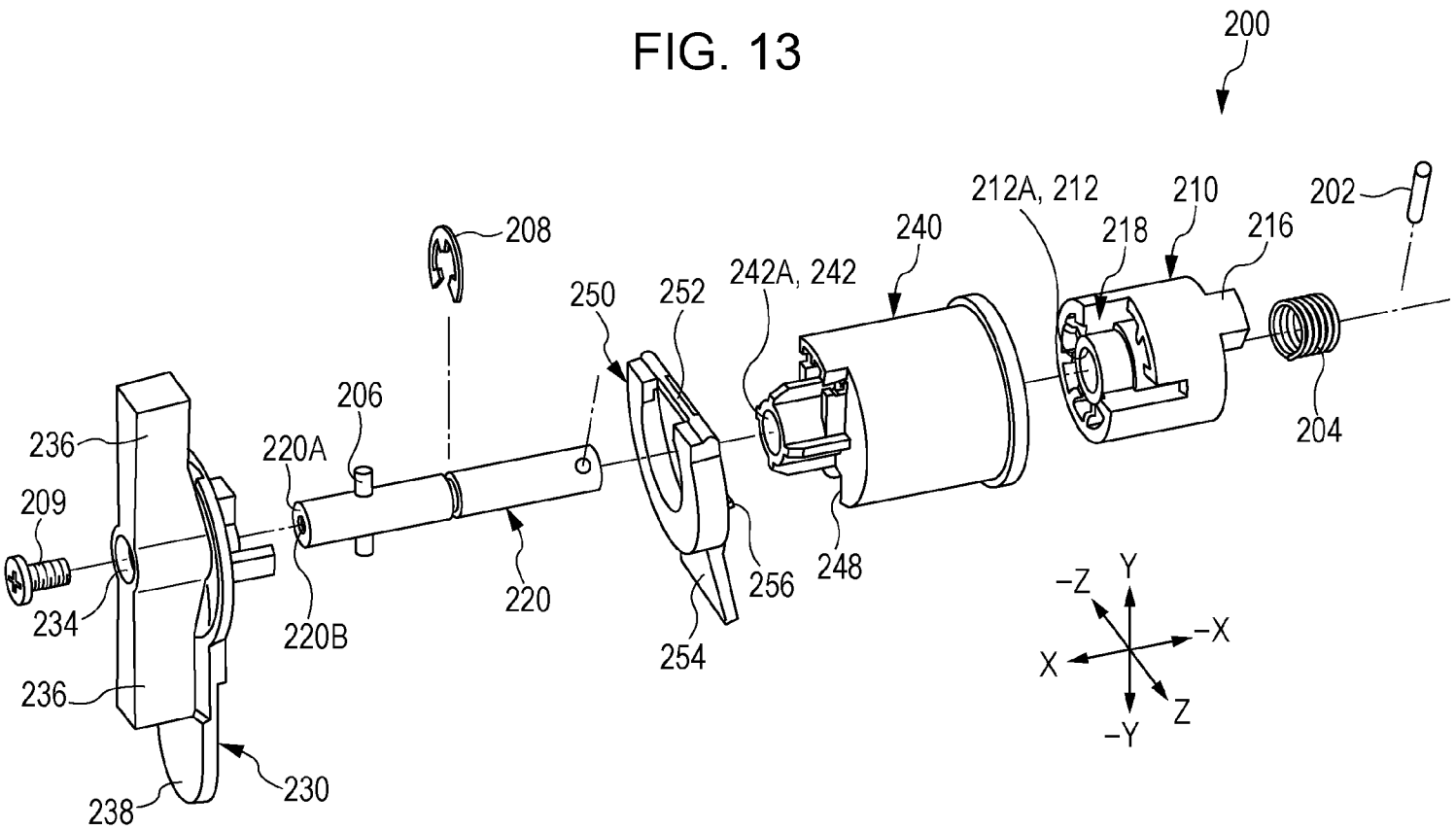
FIG. 13 is an exploded perspective view illustrating the structure of the transmission mechanism.
Figure 14:
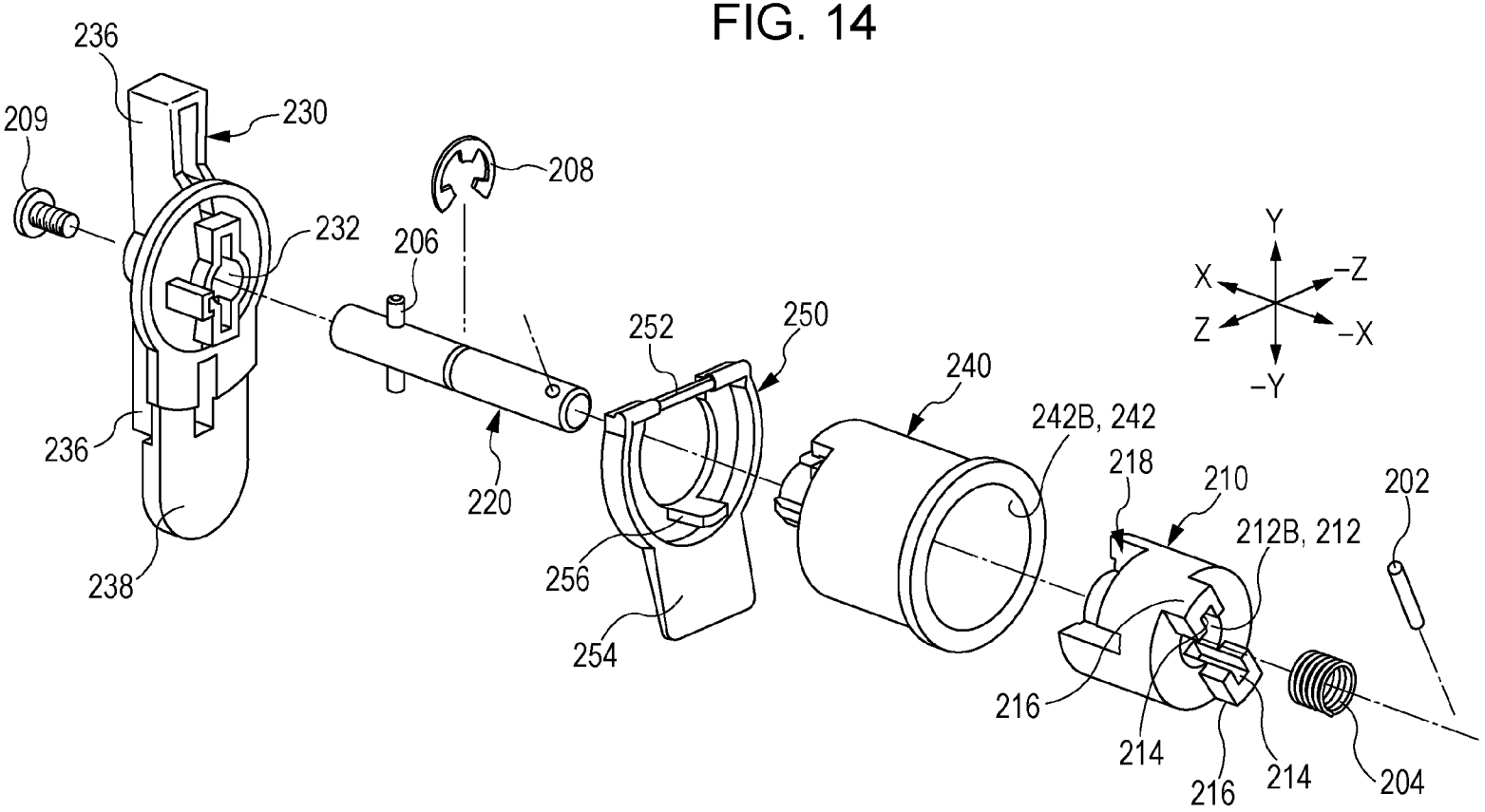
FIG. 14 is an exploded perspective view illustrating the structure of the transmission mechanism.

As illustrated in FIGS. 12, 13, and 14, the transmission mechanism 200 includes a second coupling 210 (hereinafter referred to as a body side coupling 210) serving as an example of a coupling member to be coupled to the transfer-unit side coupling 148, a rotation shaft 220 that has the body side coupling 210 at one end in the axial direction and that corotates with the body side coupling 210, a handle 230 serving as an example of an operating portion provided at the other end of the rotation shaft 220 in the axial direction, and a receiving member 240 that receives the body side coupling 210.

The rotation shaft 220 is shaped like a column, as illustrated in FIG. 13, and is provided coaxially with the rod 136 on an X-direction side of the rod 136, as illustrated in FIG. 12. At one end (−X-direction side end) of the rotation shaft 220 in the axial direction, a columnar pin 202 penetrates the rotation shaft 220 in the radial direction, and is fixed thereto. At the other end (X-direction side end) of the rotation shaft 220 in the axial direction, a columnar pin 206 penetrates the rotation shaft 220 in the radial direction, and is fixed thereto. The pin 202 and the pin 206 penetrate the rotation shaft 220 at different positions in the circumferential direction. That is, the pin 202 and the pin 202 intersect with each other, as viewed in the axial direction of the rotation shaft 220 (in the X-direction).

An end face 220A at the other end (X-direction side end) of the rotation shaft 220 in the axial direction has a threaded hole 220B in which a screw 209 is to be screwed in the axial direction of the rotation shaft 220. A fall-preventive member 208 is fixed on a middle portion of the rotation shaft 220 in the axial direction such as to protrude from an outer peripheral surface of the rotation shaft 220.

As illustrated in FIGS. 13 and 14, the body side coupling 210 is shaped like a cylinder having, at an axial center, a through-hole 212 through which the rotation shaft 220 is inserted. Since the rotation shaft 220 is inserted through the through-hole 212, the body side coupling 210 is movable relative to the rotation shaft 220 in the axial direction of the rotation shaft 220. More specifically, the body side coupling 210 is movable in the axial direction of the rotation shaft 220 between a coupled position and a withdrawal position. At the coupled position, the body side coupling 210 is coupled to the transfer-unit side coupling 148 with below-described projections 216 fitted in the recess 148A of the transfer-unit side coupling 148 (see FIGS. 6 and 15). At the withdrawal position, the projections 216 come out of the recess 148A of the transfer-unit side coupling 148, and the body side coupling 210 withdraws from the transfer-unit side coupling 148.

As illustrated in FIG. 12, the through-hole 212 includes a small-diameter portion 212A having an inner peripheral surface with which the outer peripheral surface of the rotation shaft 220 contacts, and a large-diameter portion 212B provided on a −X-direction side of the small-diameter portion 212A and having an inner diameter larger than that of the small-diameter portion 212A. A compression spring (torsion coil spring) 204 serving as an example of a biasing member through which the rotation shaft 220 is inserted is provided between the large-diameter portion 212B of the through-hole 212 and the outer peripheral surface of the rotation shaft 220. One end of the compression spring 204 in the axial direction contacts with the pin 202 fixed to the one end (−X-direction side end) of the rotation shaft 220 in the axial direction, and the other end of the compression spring 204 in the axial direction contacts with a stepped portion 212C defined between the small-diameter portion 212A and the large-diameter portion 212B, so that the body side coupling 210 is biased in the X-direction. Therefore, when the body side coupling 210 does not receive external force in the −X-direction, it is located at the withdrawal position.

As illustrated in FIG. 14, a pair of projections 216 to be fitted in the recess 148A of the transfer-unit side coupling 148 (see FIGS. 6 and 15) are provided on a face (−X-direction side face) of the body side coupling 210 facing the transfer-unit side coupling 148. The projections 216 are provided on both sides of the axial center in the radial direction, as viewed in the X-direction.

Opposing faces of the projections 216 have insertion grooves 214 in which the pin 202 fixed to one end of the rotation shaft 220 (−X-direction side end) is to be inserted. The insertion grooves 214 extend in the axial direction of the body side coupling 210, and reach a part of the large-diameter portion 212B of the through-hole 212.

The pin 202 contacts with faces in the insertion grooves 214 pointing in the −X-direction, and this restricts movement of the body side coupling 210 in the −X-direction. In a state in which the pin 202 is inserted in the insertion grooves 214, the body side coupling 210 corotates with the rotation shaft 220.

Figure 15:
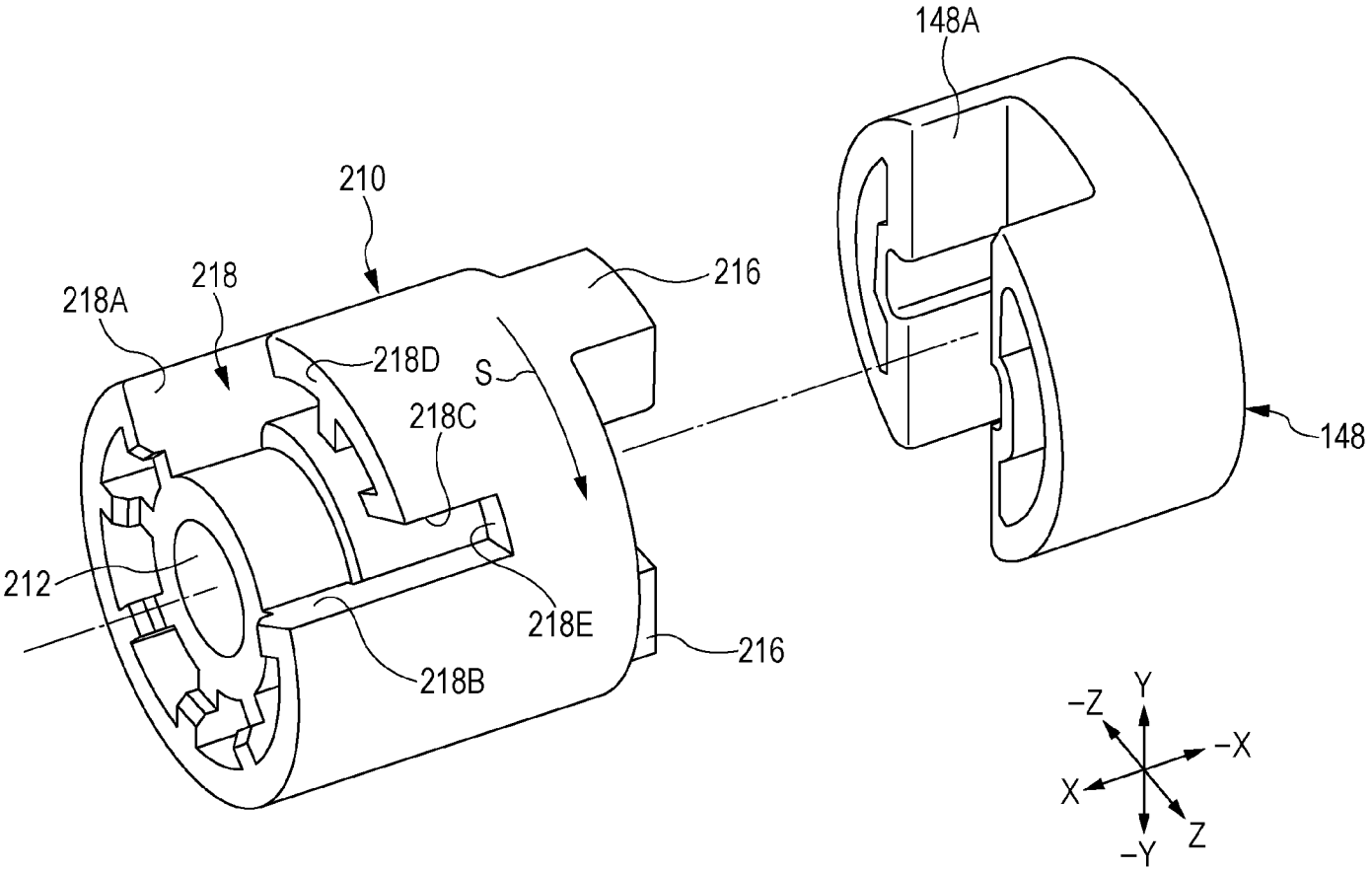
FIG. 15 is a perspective view illustrating structures of a body side coupling and a transfer-unit side coupling.

As illustrated in FIG. 15, a cutout portion 218 is provided in an X-direction side portion of the body side coupling 210 and in a part of an outer peripheral portion of the body side coupling 210. In the cutout portion 218, a below-described restricting body 244 (see FIG. 18) provided on an inner peripheral surface of the receiving member 240 is to be fitted. A part of the cutout portion 218 in the circumferential direction (a portion in the S-direction in FIG. 15) is dented deep in the −X-direction. This cutout portion 218 defines restricted faces 218A, 218B, and 218C that restrict the body side coupling 210 in movement in the circumferential direction by contact with the restricting body 244. Also, the cutout portion 218 defines restricted faces 218D and 218E that restrict the body side coupling 210 in movement in the X-direction by contact with the restricting body 244. Since the restricted faces 218D and 238E restrict movement of the body side coupling 210 in the X-direction, the pin 202 is kept inserted in the insertion grooves 214, and the body side coupling 210 always corotates with the rotation shaft 220. A manner in which the restricted faces 218A, 218B, 218C, 218D, and 218E restrict the movement of the body side coupling 210 will be specifically described below.

As illustrated in FIG. 13, the receiving member 240 is shaped like a cylinder having, at an axial center, a through-hole 242 through which the rotation shaft 220 is inserted. As illustrated in FIG. 12, the through-hole 242 includes a small-diameter portion 242A having an inner peripheral surface with which the outer peripheral surface of the rotation shaft 220 contacts, and a large-diameter portion 242B provided on an −X-direction side of the small-diameter portion 242A and having an inner diameter larger than that of the small-diameter portion 242A. The large-diameter portion 242B of the through-hole 242 receives the body side coupling 210.

As illustrated in FIG. 12, the receiving member 240 is fixed to the apparatus body 10A, and does not move in the axial direction and circumferential direction. In the receiving member 240, the fall-preventive member 208 fixed on the middle portion of the rotation shaft 220 in the axial direction contacts with a stepped portion 246 defined between the small-diameter portion 242A and the large-diameter portion 242B, so that the rotation shaft 220 is restricted in movement in the axial direction (X-direction) and is prevented from falling off the receiving member 240 in the X-direction.

At the other end of the receiving member 240 in the axial direction (X-direction side end), a swing member 250 is provided as an example of a moving mechanism that moves the body side coupling 210 in the −X-direction. At the bottom of the swing member 250 (−Y-direction side end), a pressed portion 254 against which a below-described toner bottle 260 is pressed is provided. At the top of the swing member 250 (Y-direction side end), a swing shaft 252 extends in the Z-direction. A −X-direction side face of the swing member 250 has a projecting portion 256 projecting toward the body side coupling 210 (in the −X-direction).

The swing shaft 252 of the swing member 250 is supported by the top of the receiving member 240 so that a lower part of the swing member 250 (projecting portion 256) swings on the swing shaft 252 in the X-direction and −X-direction.

The below-described toner bottle 260 is pressed against the pressed portion 254 to swing the swing member 250 on the swing shaft 252. Thus, the projecting portion 256 of the swing member 250 protrudes into the receiving member 240 through an opening 248, and presses the body side coupling 210 in the X-direction. The body side coupling 210 is thereby moved against the biasing force of the compression spring 204 to a coupled position coupled to the transfer-unit side coupling 148.

When the toner bottle 260 is not pressed against the pressed portion 254, the projecting portion 256 of the swing member 250 is out of the receiving member 240 through the opening 248, and the body side coupling 210 is not pressed in the X-direction, the body side coupling 210 is moved by the biasing force of the compression spring 204 to a withdrawal position withdrawn from the transfer-unit side coupling 148.

As illustrated in FIG. 13, the handle 230 includes a grip 236 that is long in the radial direction of the rotation shaft 220. The handle 230 is turned with the grip 236 being grasped.

As illustrated in FIG. 14, an −X-direction side end of the handle 230 has an insertion groove 232 in which the other end of the rotation shaft 220 in the axial direction (X-direction side end) and the pin 206 fixed to the other end of the rotation shaft 220 are to be inserted in the axial direction (X-direction) of the rotation shaft 220. The handle 230 also has a through-hole 234 in which the screw 209, which is to be screwed in the threaded hole 220B of the rotation shaft 220 fitted in the insertion groove 232, is inserted. By screwing the screw 209 inserted in the through-hole 234 into the threaded hole 220B of the rotation shaft 220, the handle 230 is fixed with the pin 206 fitted in the insertion groove 232, and corotates with the rotation shaft 220.

Figure 16:
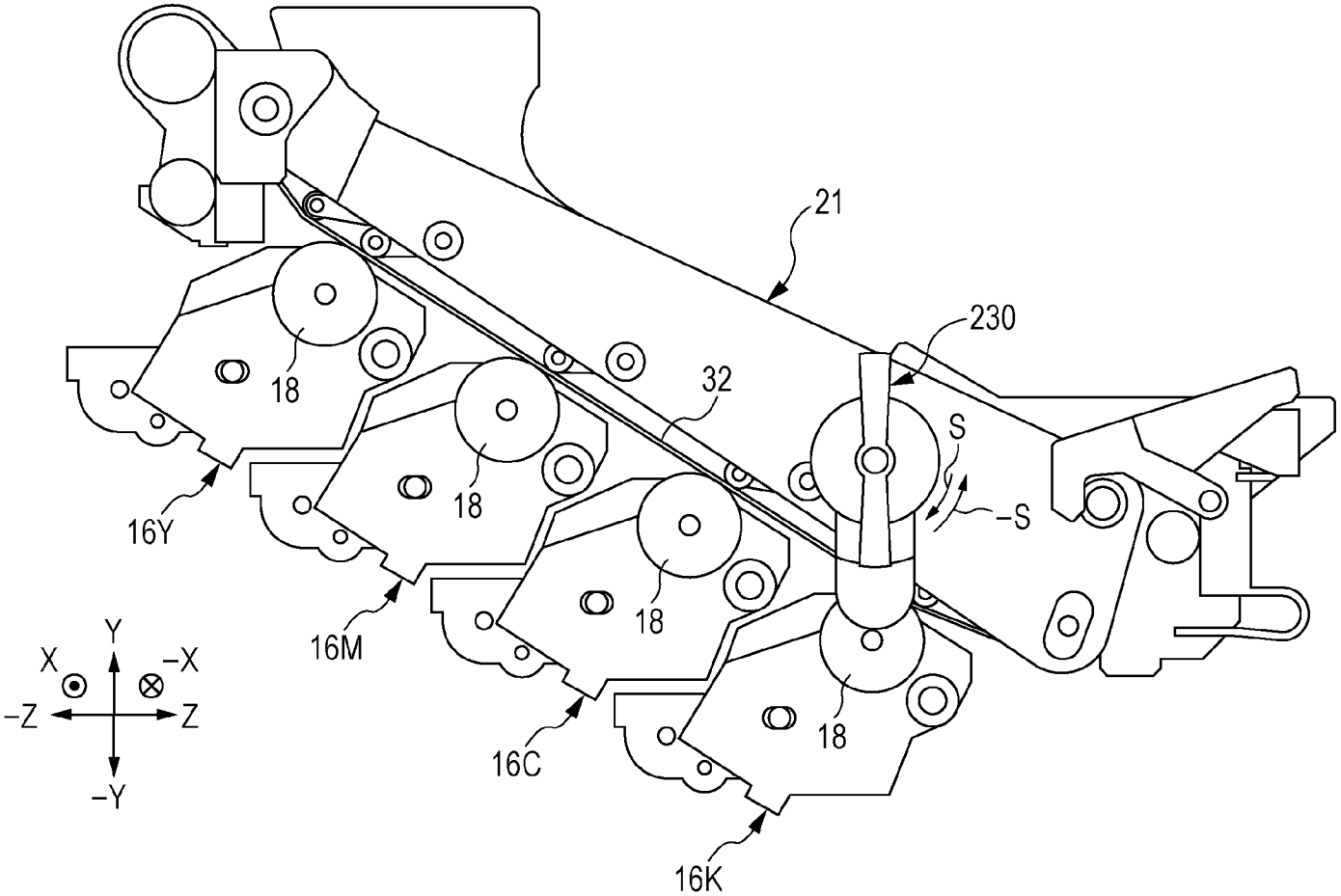
FIG. 16 is a side view illustrating a state in which an intermediate transfer belt is in contact with image carriers.

In a state in which the body side coupling 210 is coupled to the transfer-unit side coupling 148, when the operator turns the handle 230 forward (in the S-direction) from a second turn position (hereinafter referred to as a separate turn position (see FIG. 17)) to a first turn position (hereinafter referred to as a contact turn position (see FIG. 16)), the contact and separation mechanism 170 moves the intermediate transfer belt 32 into contact with the image carriers 18, as illustrated in FIG. 16. More specifically, when the handle 230 is turned forward to the contact turn position, the rod 136 rotates, the regulation roller 82 and the first transfer rollers 34Y, 34M, 34C, and 34K come into contact with the intermediate transfer belt 32 in a multicolor transfer mode to bring the intermediate transfer belt 32 into contact with the image carriers 18 (see FIG. 2), as described above. In a monochromatic transfer mode, when the rod 136 rotates, the first transfer roller 34K comes into contact with the intermediate transfer belt 32, and brings the intermediate transfer belt 32 into contact with the corresponding image carrier 18 (FIG. 3).

Figure 17:
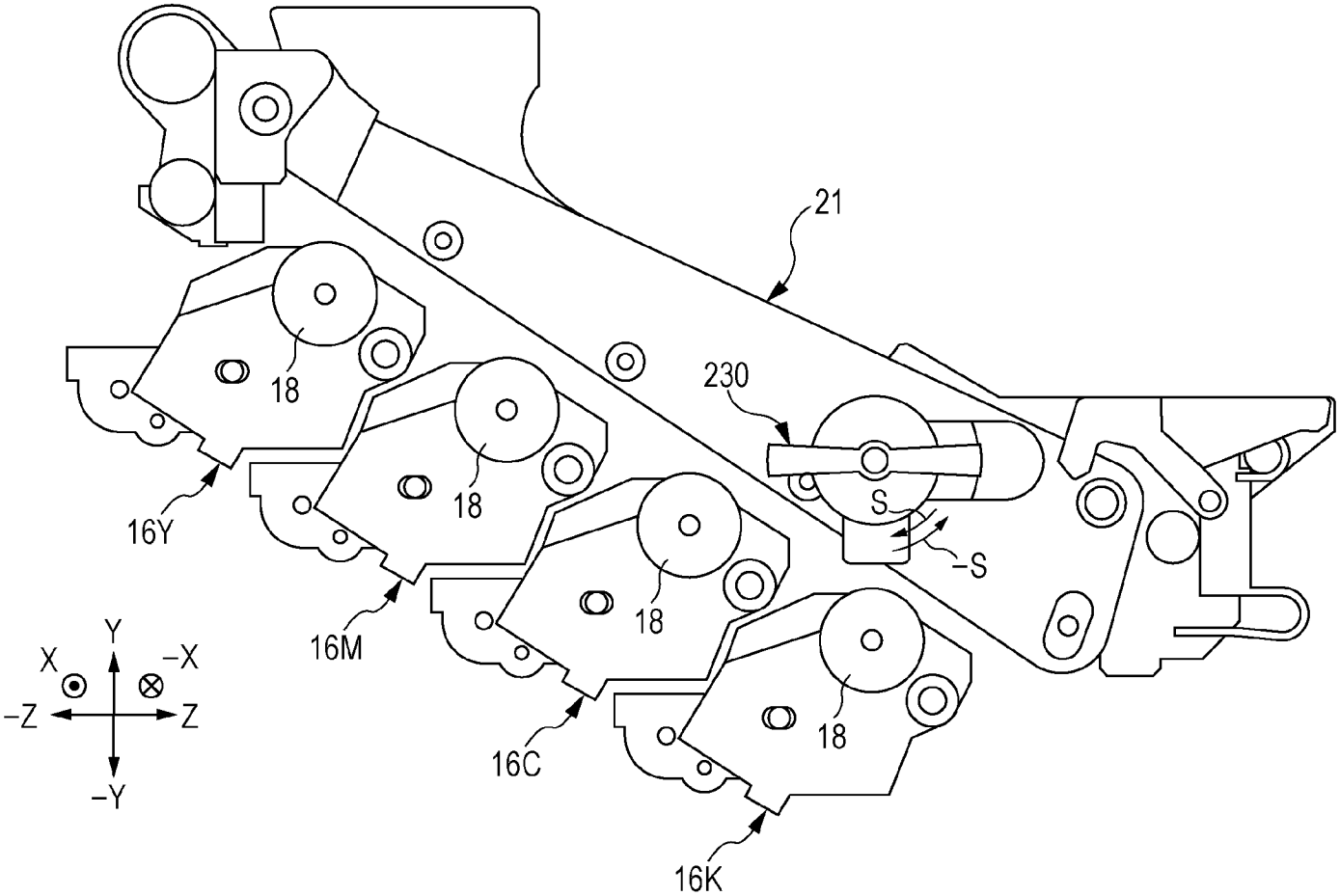
FIG. 17 is a side view illustrating a state in which the intermediate transfer belt is separate from the image carriers.

In a state in which the body side coupling 210 is coupled to the transfer-unit side coupling 148, when the operator turns the handle 230 in reverse (in the −S direction) from a contact turn position to a separate turn position, the contact and separation mechanism 170 separates the intermediate transfer belt 32 from the image carriers 18, as illustrated in FIG. 17. More specifically, when the handle 230 is turned in reverse to the separate turn position, the rod 136 rotates, and the regulation roller 82 and the first transfer rollers 34Y, 34M, 34C, and 34K withdraw from the intermediate transfer belt 32 to separate the intermediate transfer belt 32 from the image carriers 18 (see FIGS. 4 and 5), as described above.

Figure 18:
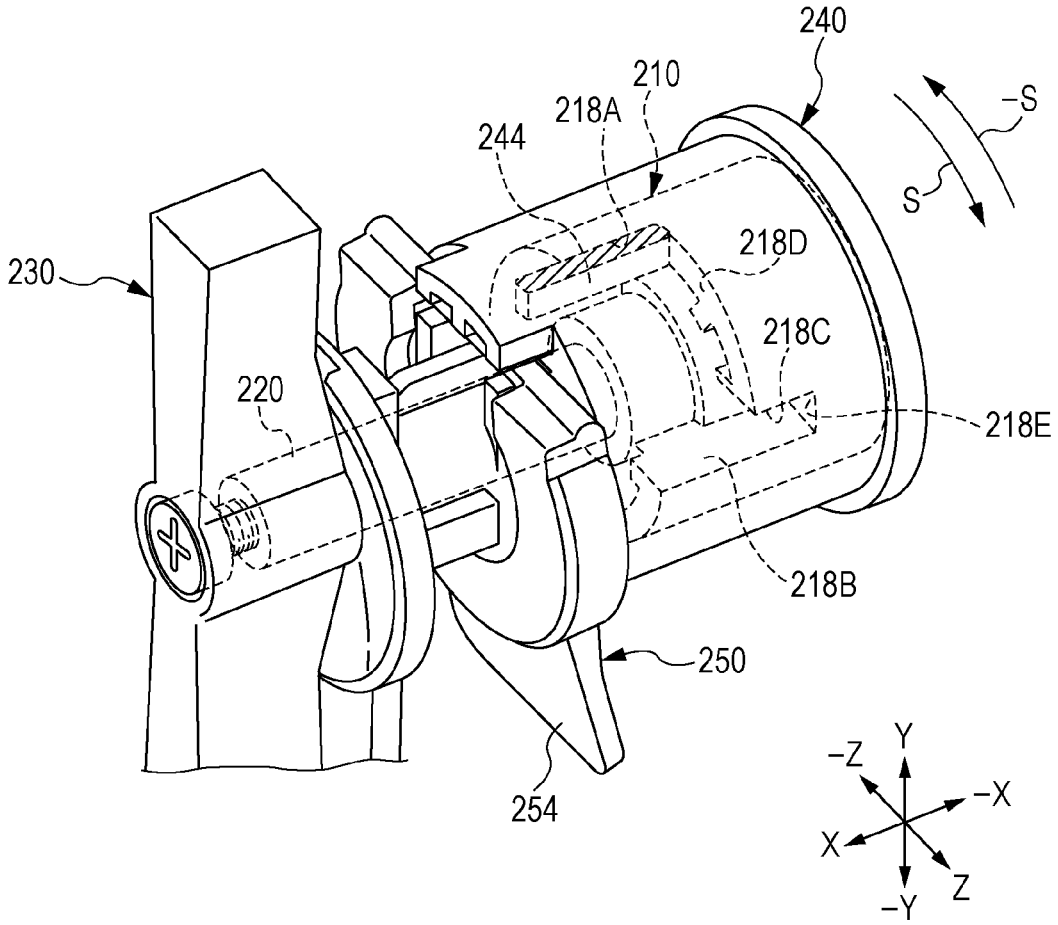
FIG. 18 is a perspective view illustrating a state in which a handle is at a contact turn position.
Figure 19:
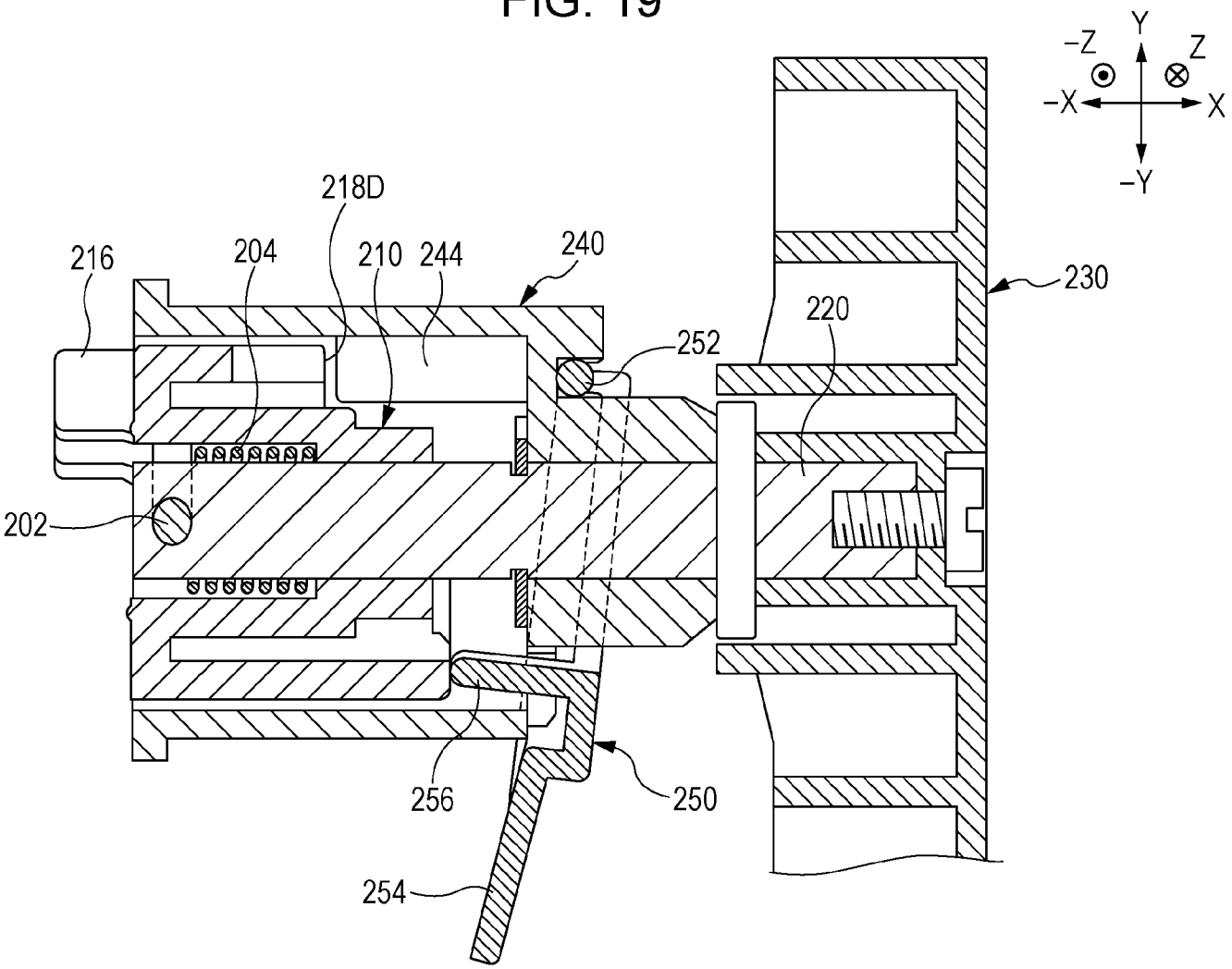
FIG. 19 is a cross-sectional view illustrating a state in which the handle is at the contact turn position.

When the handle 230 is turned forward (in the S-direction) in a state in which the body side coupling 210 is coupled to the transfer-unit side coupling 148, as illustrated in FIG. 18, the restricted face 218A of the body side coupling 210 that corotates with the handle 230 comes into contact with the restricting body 244 of the receiving member 240 in the circumferential direction of the body side coupling 210. Thus, the forward turn (turn in the S-direction) is restricted, and the handle 230 and the body side coupling 210 are placed at a contact turn position. As illustrated in FIGS. 18 and 19, at the contact turn position, the restricted face 218D of the body side coupling 210 comes into contact with the restricting body 244 of the receiving member 240 in the axial direction of the body side coupling 210. This restricts the body side coupling 210 in movement in the X-direction. That is, the body side coupling 210 is prohibited from moving to a withdrawal position.

Figure 20:
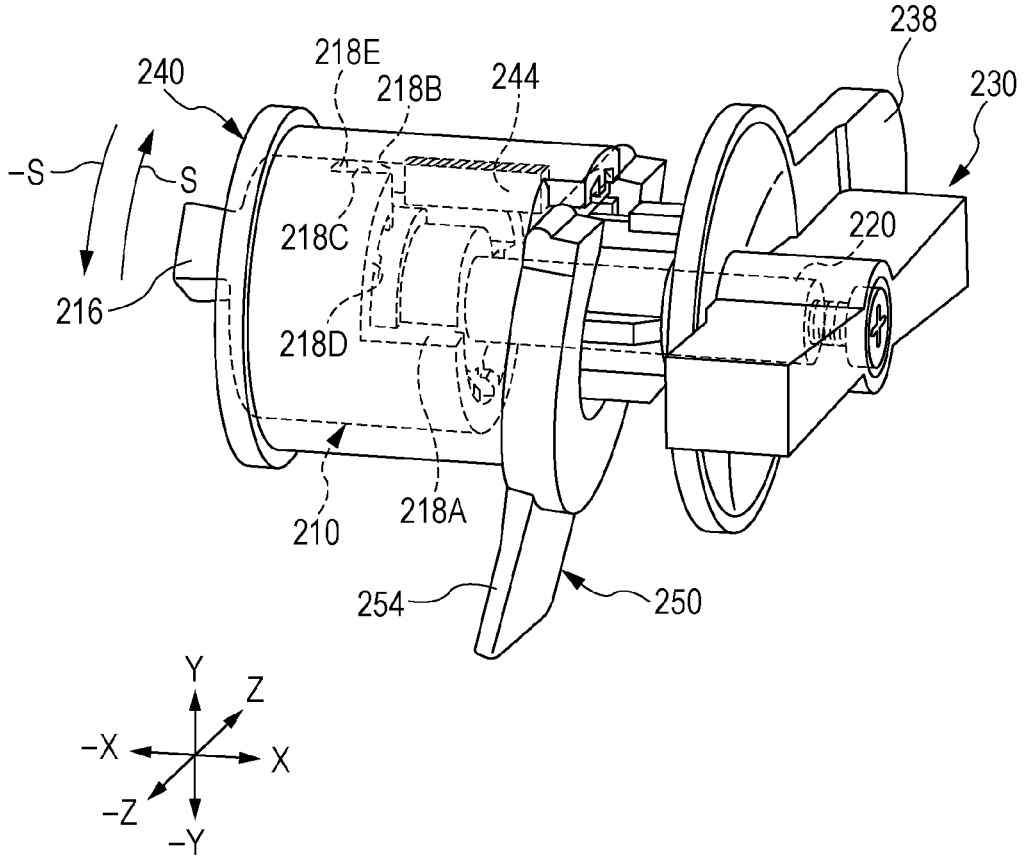
FIG. 20 is a perspective view illustrating a state in which the handle is at a separate turn position and the body side coupling is at a coupled position.
Figure 21:
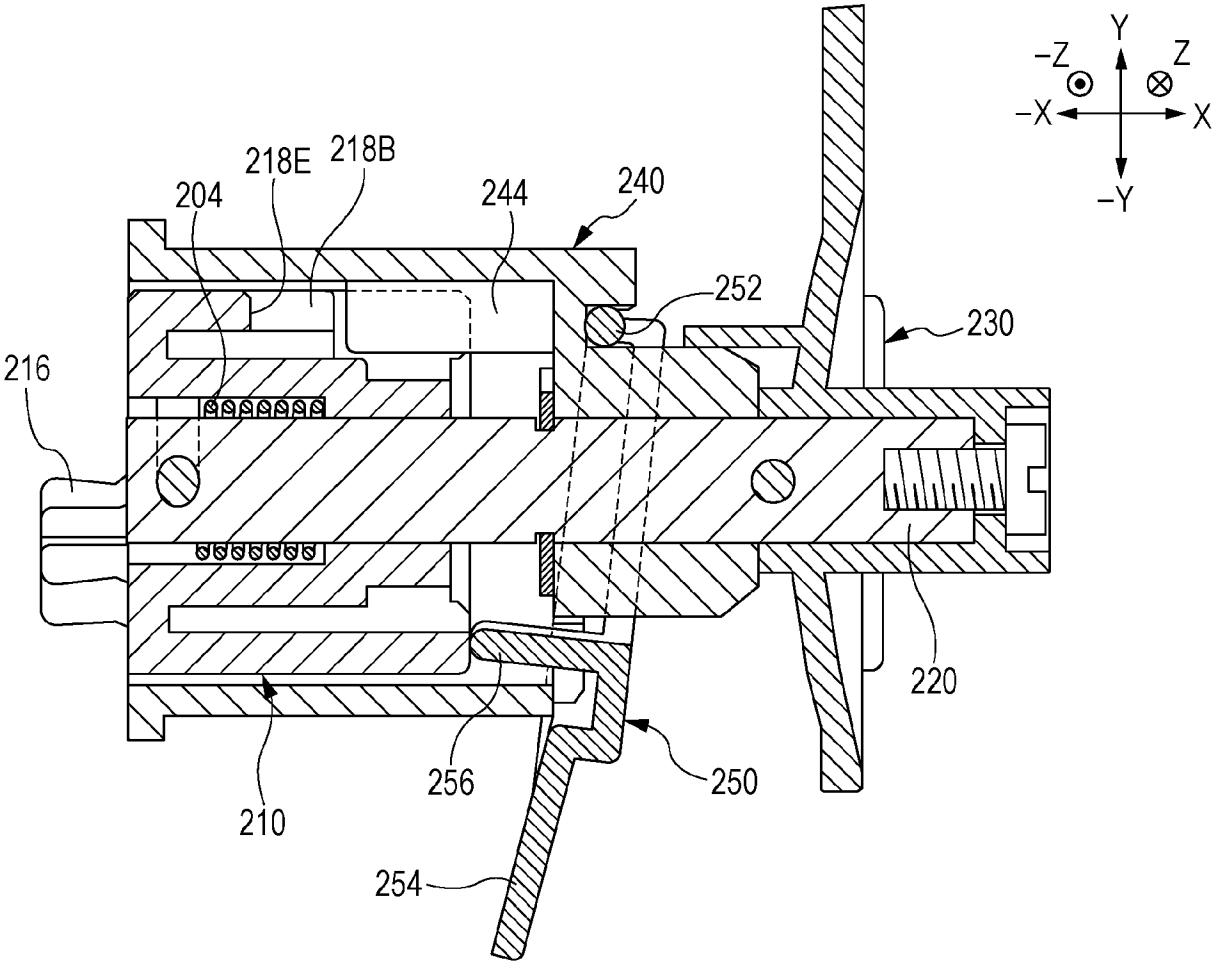
FIG. 21 is a cross-sectional view illustrating the state in which the handle is at the separate turn position and the body side coupling is at the coupled position.

In the state in which the body side coupling 210 is coupled to the transfer-unit side coupling 148, when the handle 230 is turned in reverse (in the −S-direction), as illustrated in FIGS. 20 and 21, the restricted face 218B of the body side coupling 210 that corotates with the handle 230 comes into contact with the restricting body 244 of the receiving member 240 in the circumferential direction of the body side coupling 210. This restricts the reverse turn, and the handle 230 and the body side coupling 210 are placed at a separate turn position. At the separate turn position, the restricted face 218D of the body side coupling 210 is not restricted by the restricting body 244 of the receiving member 240, and the body side coupling 210 is movable in the X-direction. That is, the body side coupling 210 is allowed to move to the withdrawal position.

Figure 22:
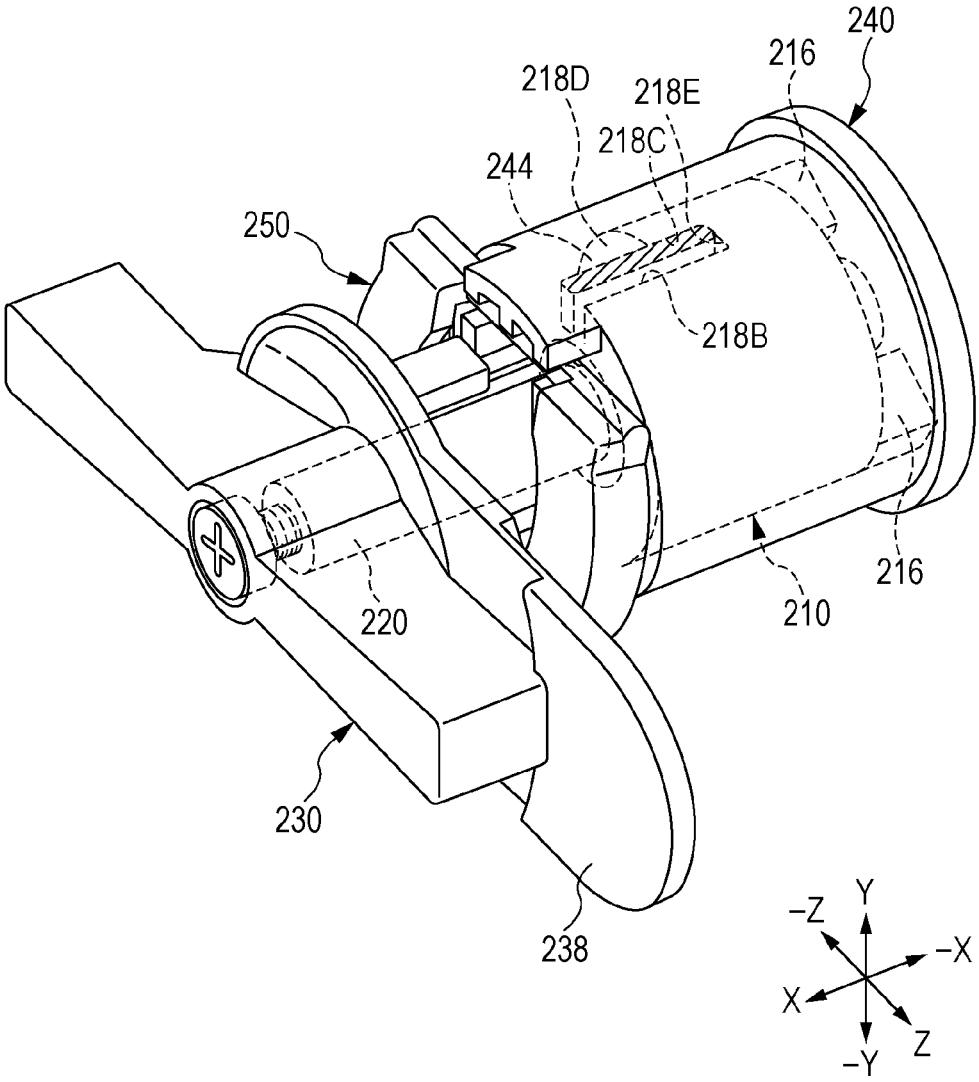
FIG. 22 is a perspective view illustrating a state in which the handle is at the separate turn position and the body side coupling is at a withdrawal position.
Figure 23:
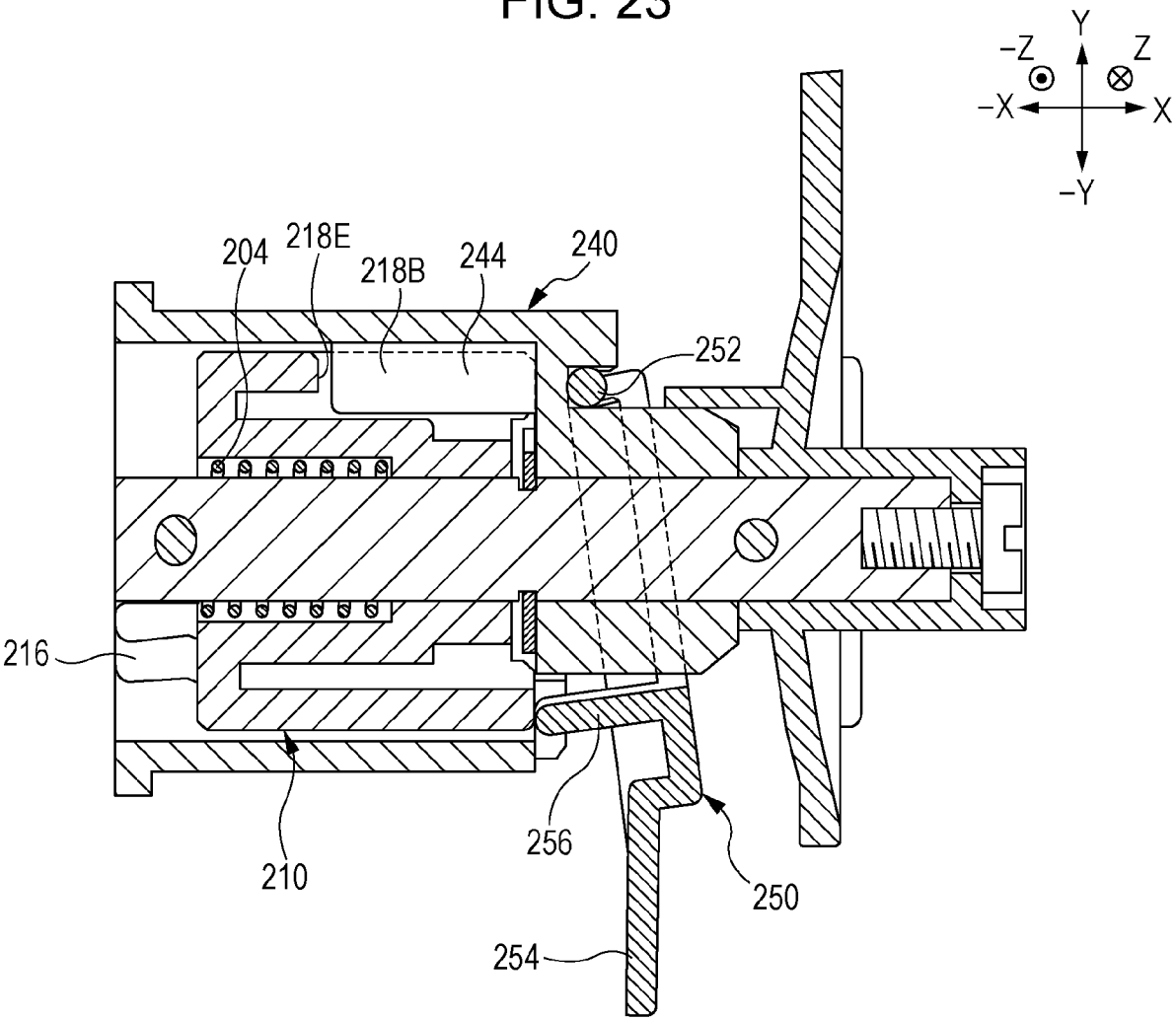
FIG. 23 is a cross-sectional view illustrating the state in which the handle is at the separate turn position and the body side coupling is at the withdrawal position.

Further, when the below-described toner bottle 260 is removed at the separate turn position, as illustrated in FIGS. 22 and 23, the body side coupling 210 is moved to the withdrawal position by the biasing force of the compression spring 204. When the restricted face 218E of the body side coupling 210 contacts with the restricting body 244 of the receiving member 240, the body side coupling 210 is restricted in movement in the X-direction beyond the predetermined withdrawal position.

When the body side coupling 210 is at the withdrawal position, the restricted face 218C of the body side coupling 210 that corotates with the handle 230 contacts with the restricting body 244 of the receiving member 240 in the circumferential direction of the body side coupling 210, so that the handle 230 is restricted in turn to the contact turn position.

The handle 230 further includes a restricting portion 238 that restricts movement of the below-described toner bottle 260 in the X-direction in a state in which the handle 230 is at the contact turn position (see FIG. 25).

Specific Structures of Removing Devices 160 and Removing Device 161

Next, specific structures of the removing devices 160 and the removing device 161 will be described.

As illustrated in FIG. 1, the removing device 160 in each of the image forming units 16Y, 16M, 16C, and 16K includes a housing 162 that stores components of the removing device 160, a removing member 164 provided in the housing 162 to remove residual toner remaining on the corresponding image carrier 18 by contact with the image carrier 18, and a transport member 166 provided in the housing 162 to transport the residual toner removed by the removing member 164 to the below-described toner bottle 260 (see FIG. 25).

The housing 162 has an opening 162A opening at a position opposing the image carrier 18 (on an image carrier 18 side). In the housing 162, a receiving space K is provided to receive the residual toner removed by the removing member 164.

The removing member 164 is provided at the opening 162A of the housing 162 in a manner such that a tip thereof is in contact with the image carrier 18. For example, the removing member 164 is formed by a blade made of rubber for scraping off the residual toner on the image carrier 18 by contact with the image carrier 18. The residual toner removed by the removing member 164 is received in the receiving space K in the housing 162, for example, because of its own weight.

Since the removing devices 160 in the image forming units 16Y, 16M, 16C, and 16K have a similar structure, reference numerals for the components of the removing devices 160 in the image forming units 16Y, 16M, and 16C are omitted in FIG. 1.

The removing device 161 in the first transfer unit 21 includes a housing 163 that stores components of the removing device 161, a removing member 165 provided in the housing 163 to remove residual toner remaining on the intermediate transfer belt 32 by contact with the intermediate transfer belt 32, and a transport member 166 provided in the housing 163 to transport the residual toner removed by the removing member 165 to the below-described toner bottle 260 (see FIG. 25).

The housing 163 has an opening 163A opening at a position opposing the intermediate transfer belt 32 (on an intermediate transfer belt 32 side (Z-direction side)). In the housing 163, a receiving space K is provided to receive the residual toner removed by the removing member 165.

The removing member 165 is provided at the opening 163A of the housing 163 in a manner such that a tip thereof is in contact with the intermediate transfer belt 32. For example, the removing member 165 is formed by a blade made of rubber for scraping off the residual toner on the intermediate transfer belt 32 by contact with the intermediate transfer belt 32. The residual toner removed by the removing member 165 is received in the receiving space K in the housing 163, for example, because of its own weight.

Figure 24:
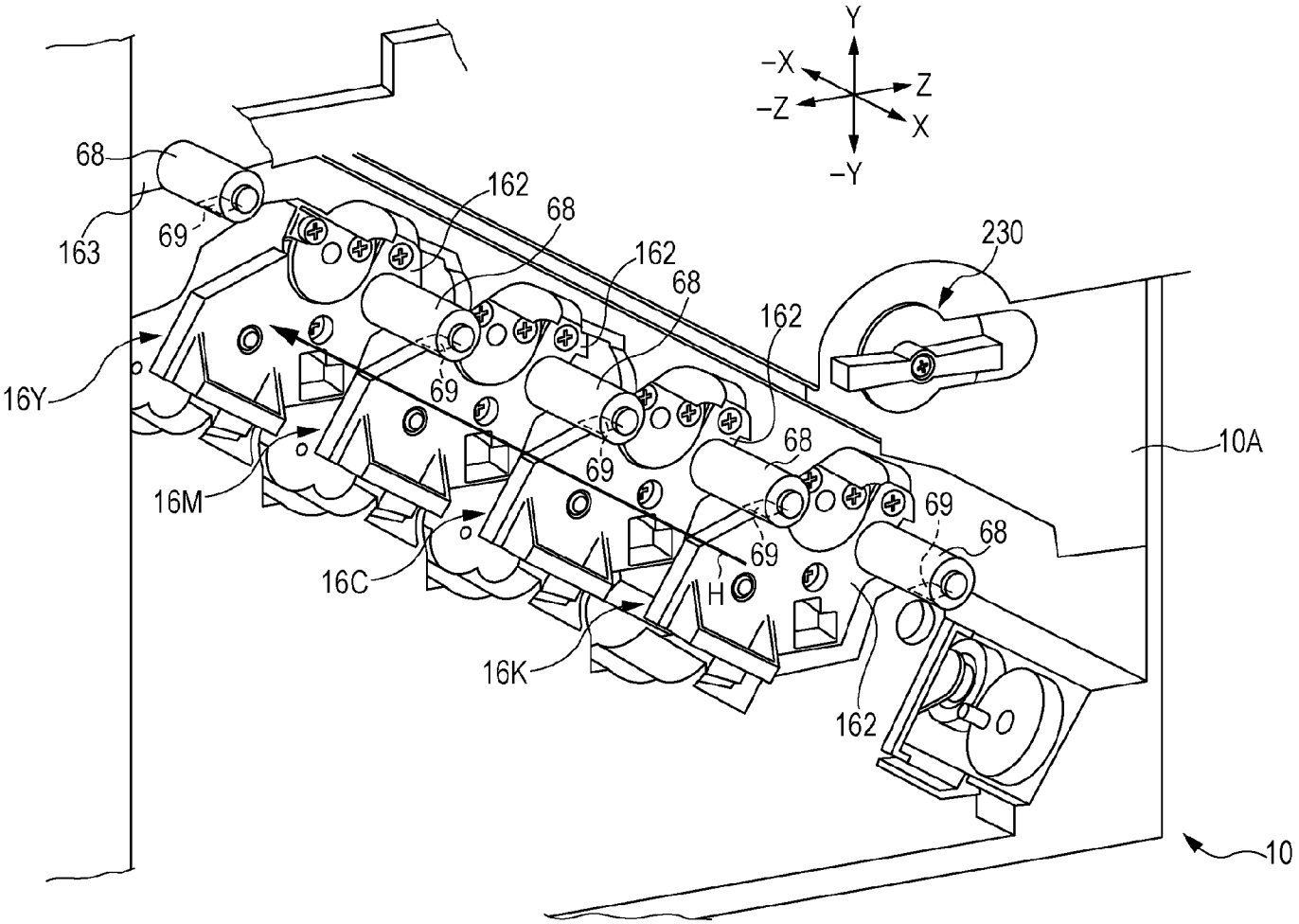
FIG. 24 is a perspective view illustrating a structure of an apparatus body from which a toner bottle is removed.

As illustrated in FIG. 24, each of the image forming units 16Y, 16M, 16C, and 16K includes a discharge pipe 68 projecting from the housing 162 of the removing device 160 in the horizontal direction (X-direction). The discharge pipe 68 communicates with the receiving space K in the housing 162 (see FIG. 1), and the residual toner received in the receiving space K in the housing 162 flows into the discharge pipe 68. As illustrated in FIGS. 24 and 6, the removing device 161 in the first transfer unit 21 includes a discharge pipe 68 projecting from the housing 163 in the horizontal direction (X-direction). The discharge pipe 68 communicates with the receiving space K in the housing 163 (see FIG. 1), and the residual toner received in the receiving space K in the housing 163 flows into the discharge pipe 68.

One end (X-direction side end) of the transport member 166 provided in each of the housings 162 and 163 (see FIG. 1) is located in the discharge pipe 68. That is, the transport member 166 extends from the receiving space K in the housing 162 (the housing 163 in the removing device 161) (see FIG. 1) into the discharge pipe 68. For example, the transport member 166 includes a spiral member spirally formed around a rotation shaft. The transport member 166 is rotated by rotation force received from an unillustrated motor so as to transport the residual toner from the receiving space K in the housing 162 (the housing 163 in the removing device 161) (see FIG. 1) into the discharge pipe 68.

On a lower side (−Y-direction side) of the X-direction side end of the discharge pipe 68, a discharge port 69 is provided. The residual toner transported by the transport member 166 is discharged from the discharge port 69. The discharge port 69 is opened and closed by an unillustrated opening and closing member.

Structure of Toner Bottle 260

Figure 25:
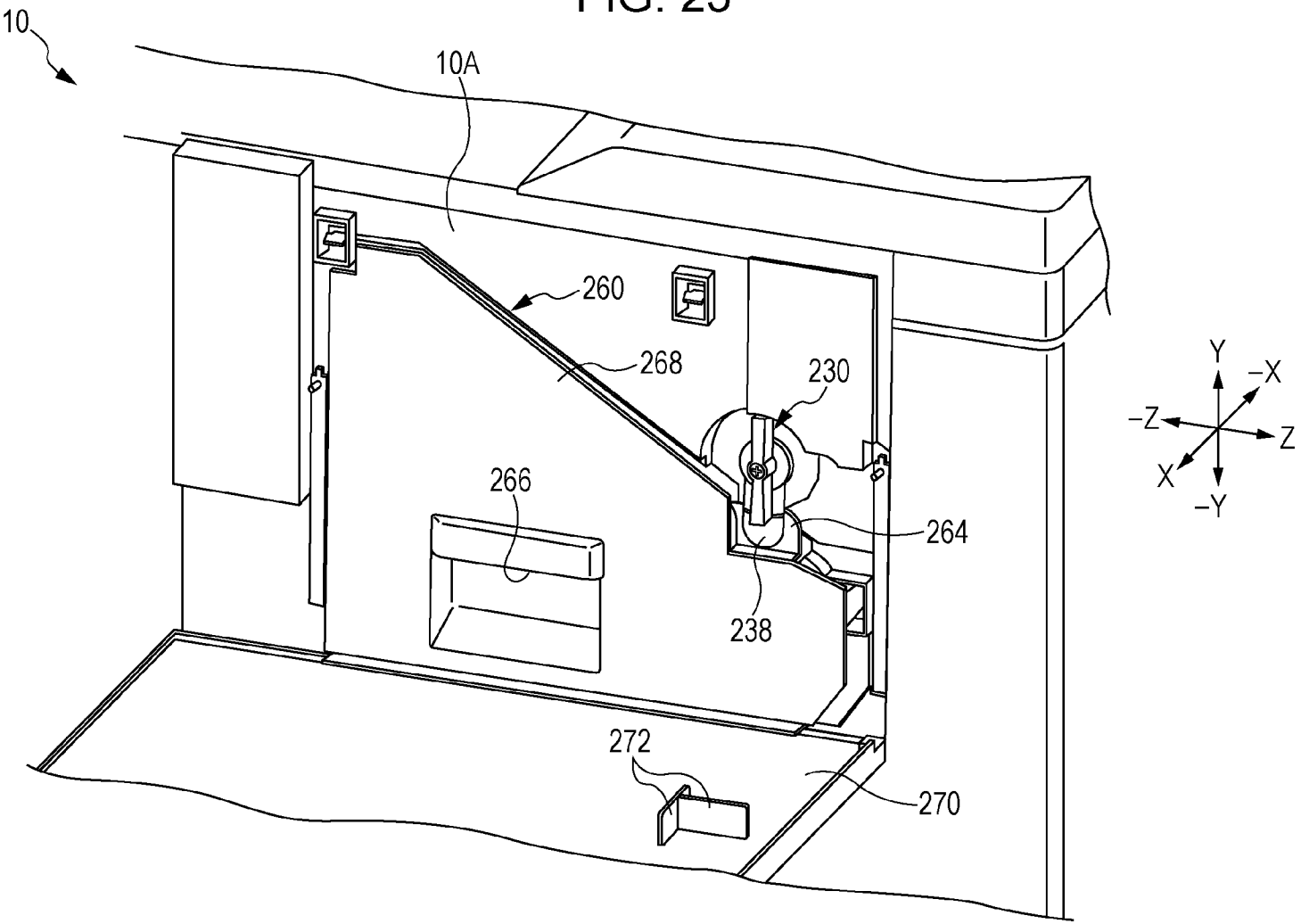
FIG. 25 is a perspective view illustrating a positional relationship between the handle at the contact turn position and the toner bottle.
Figure 26:
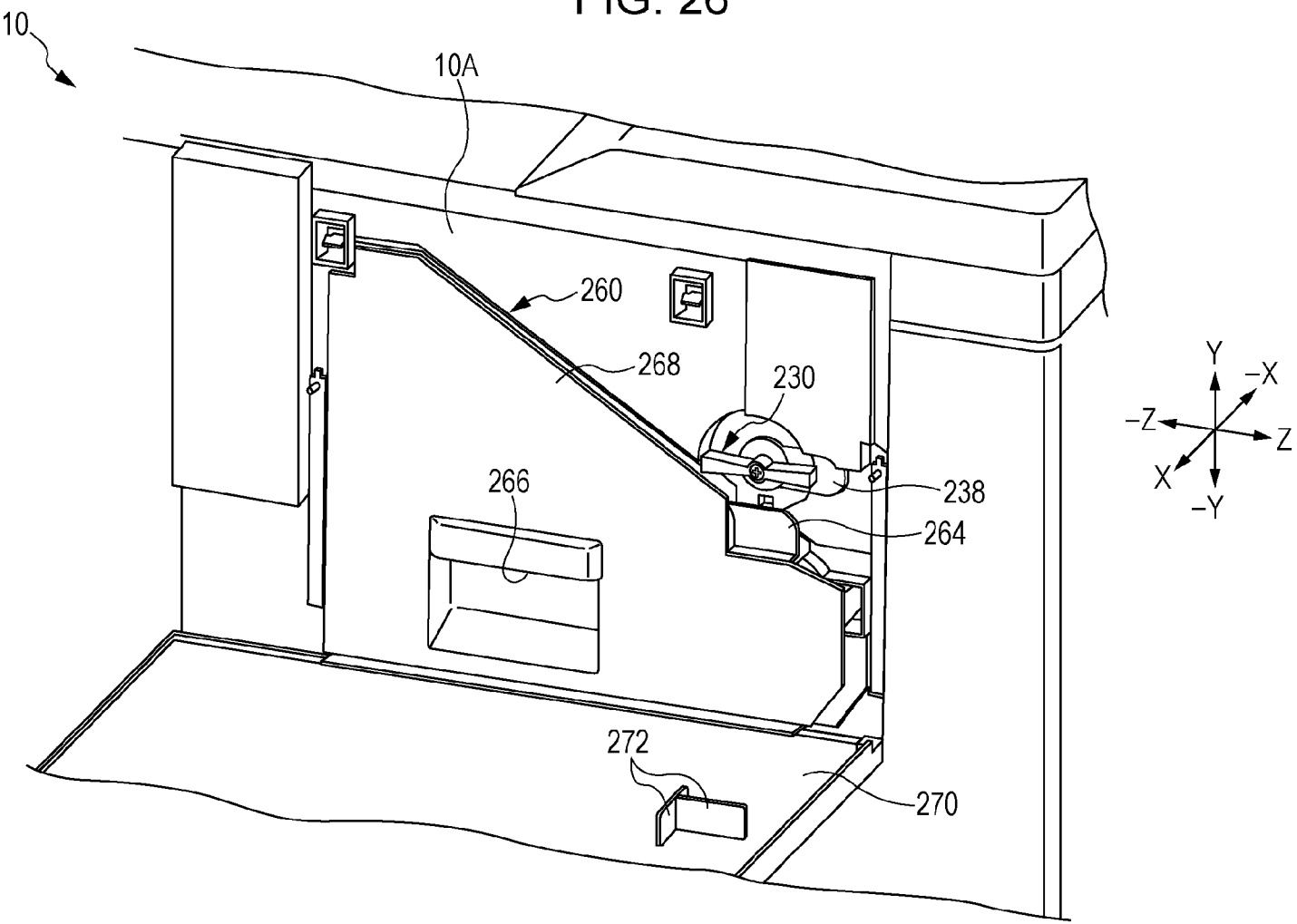
FIG. 26 is a perspective view illustrating a positional relationship between the handle at the separate turn position and the toner bottle.

As illustrated in FIGS. 25 and 26, the toner bottle 260 is detachably mounted in an X-direction side of the apparatus body 10A. The toner bottle 260 serves as an example of a container that contains developer removed from the intermediate transfer belt 32.

The toner bottle 260 includes a housing 268 that receives residual toner discharged from the discharge ports 69 of the discharge pipes 68 (see FIG. 24). The housing 268 has a grip portion 266 to be grasped at the time of attachment and detachment of the toner bottle 260.

Figure 27:
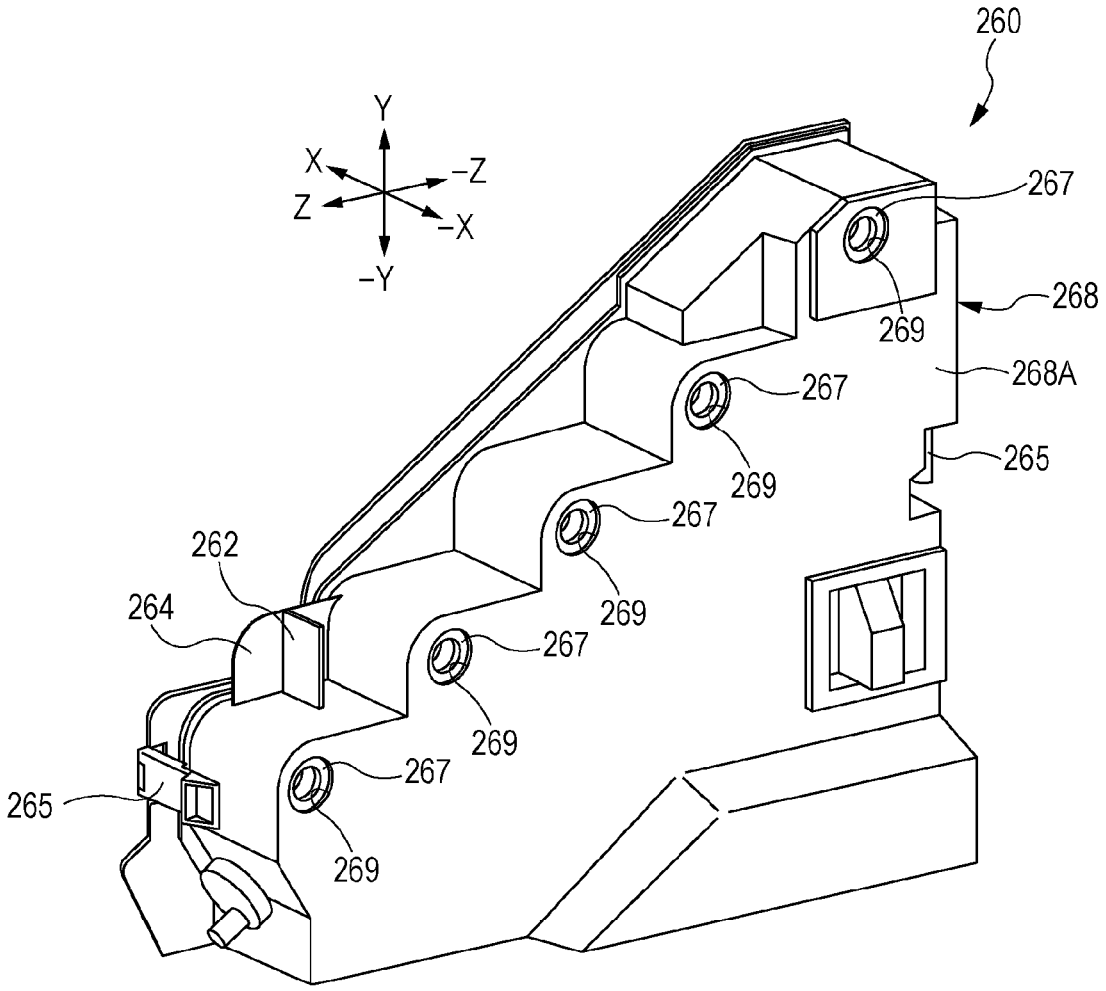
FIG. 27 is a perspective view illustrating a structure of the toner bottle.

As illustrated in FIG. 27, the housing 268 has two latches 265 serving as fixing members detachably fixed to the apparatus body 10A. The latches 265 allow the toner bottle 260 to be attached to and detached from the apparatus body 10A.

A −X-direction side surface of the housing 268 has insertion holes 269 in which the discharge pipes 68 are to be inserted. In the exemplary embodiment, five insertion holes 269 are arranged at positions corresponding to the plural discharge pipes 68 in an arrangement direction H of the discharge pipes 68 (see FIG. 24). Thus, the five discharge pipes 68 are inserted in the corresponding insertion holes 269 together (at a time). The insertion holes 269 are shaped like circular holes provided through a side wall 268A of the housing 268 in the thickness direction. Seal members 267 are provided at ridges of the insertion holes 269 to seal portions between the discharge pipes 68 inserted in the insertion holes 269 and the side wall 268A of the housing 268.

In this way, in the exemplary embodiment, the discharge pipes 68 serving as insertion members projecting in the X-direction in the first transfer unit 21 are inserted in the insertion holes 269 of the toner bottle 260. Hence, in a state in which the toner bottle 260 is detached from the apparatus body 10A (that is, in a state in which the discharge pipes 68 are not inserted in the insertion holes 269), the first transfer unit 21 is allowed to be detached from the apparatus body 10A. That is, an interference member (toner bottle 260), which may interfere with an interfered member (discharge pipes 68) taken out from the apparatus body 10A together with the first transfer unit 21 (intermediate transfer belt 32), withdraws from the interfered member.

A cover 270 is provided on the X-direction side of the apparatus body 10A. The cover 270 serves as an example of an opening and closing portion that covers the toner bottle 260 attached to the apparatus body 10A. A lower portion of the cover 270 is supported by the apparatus body 10A such as to be turnable about the Z-direction. By turning an upper portion of the cover 270 about the lower portion, the X-direction side of the apparatus body 10A is opened. In an open state of the cover 270, the toner bottle 260 is attached to and detached from the apparatus body 10A in the X- and −X direction.

As illustrated in FIGS. 25 and 26, in the open state of the cover 270, the handle 230 is exposed to the outside and is allowed to be turned.

The toner bottle 260 has a restricted portion 264 that is restricted in movement by the restricting portion 238 of the handle 230. In a state in which the toner bottle 260 is attached to the apparatus body 10A, when the handle 230 is turned from a separate turn position (see FIG. 26) to a contact turn position (see FIG. 25), the restricting portion 238 of the handle 230 covers the restricted portion 264 of the toner bottle 260 on the X-direction side, so that movement of the toner bottle 260 in the X-direction is restricted.

Figure 28:
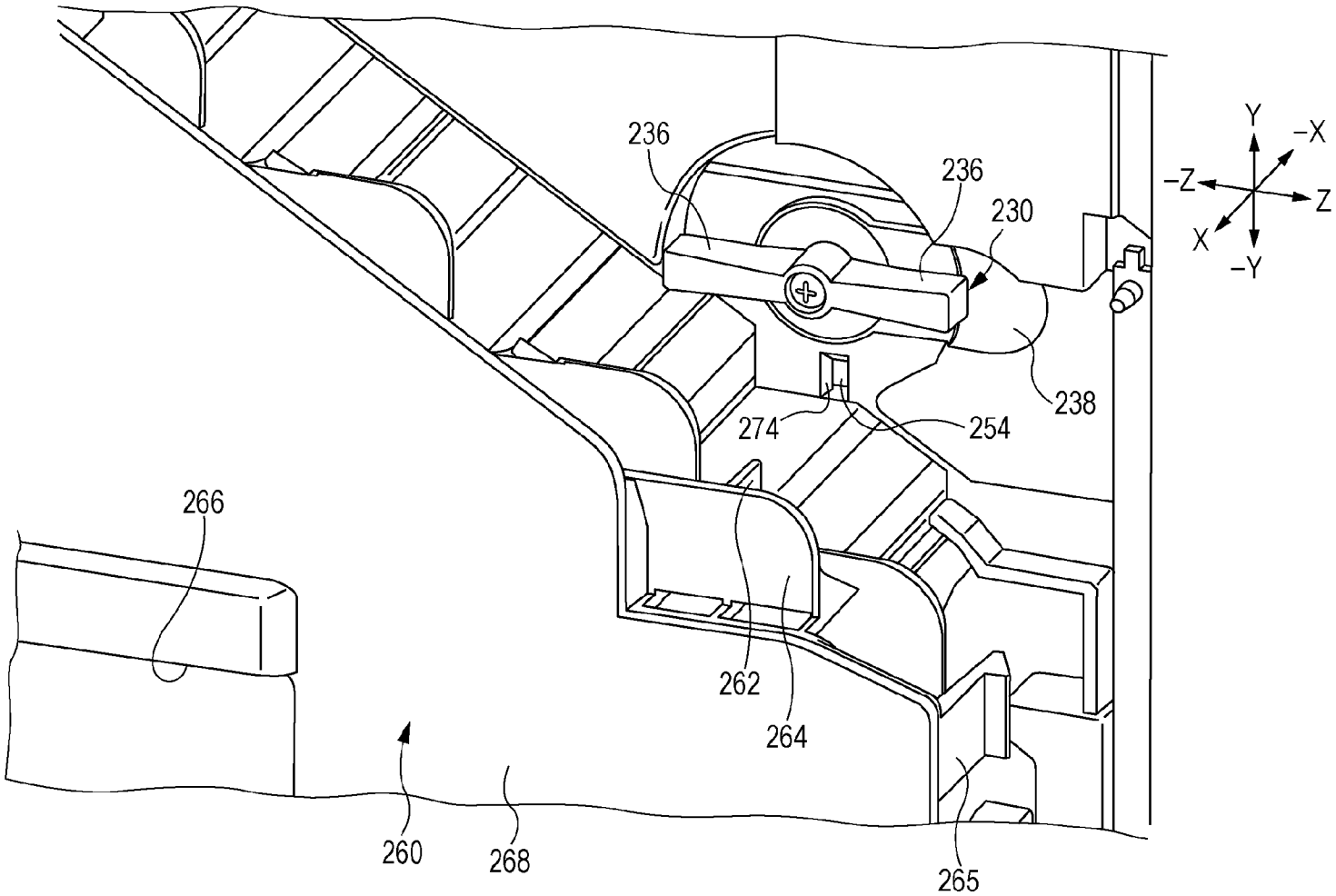
FIG. 28 is a perspective view illustrating a structure of a pressing rib of the toner bottle.

As illustrated in FIG. 28, the toner bottle 260 has a pressing rib 262 serving as a pressing portion to be pressed against the pressed portion 254 of the swing member 250. On the X-direction side of the apparatus body 10A, a cutout portion 274 is provided such that the pressing rib 262 is inserted therein in association with attachment of the toner bottle 260 to the apparatus body 10A. When the toner bottle 260 is attached to the apparatus body 10A, the pressing rib 262 is pressed against the pressed portion 254 of the swing member 250.

As illustrated in FIGS. 25 and 26, the cover 270 has a rib 272. The rib 272 contacts with the handle 230 to prohibit the cover 270 from closing the apparatus body 10A when the handle 230 is at the separate turn position, and does not contact with the handle 230 and allows the cover 270 to close the apparatus body 10A when the handle 230 is at the contact turn position.

Operation of First Transfer Unit 21

Next, as an operation of the first transfer unit 21, a shift from a multicolor transfer mode to a monochromatic transfer mode, a shift from a monochromatic transfer mode to a withdrawal mode, and a shift from a multicolor transfer mode to a withdrawal mode will be described.

As illustrated in FIGS. 2 and 6, in a multicolor transfer mode for outputting an image in plural colors, the first transfer rollers 34 corresponding to the colors are in contact with the back surface of the intermediate transfer belt 32.

That is, the regulation roller 82 and the first transfer rollers 34Y, 34M, and 34C are located at a first position, and the first transfer roller 34K is located at a third position. Tension is applied from the tensioning roller 40 to the intermediate transfer belt 32.

The contact faces 124 of the first moving members 112 are in contact with the short diameter sides of the cam members 126, and the contact faces 144 of the first moving members 112 and the contact faces 140 of the second moving members 132 are in contact with the short diameter sides of the cam members 142.

For example, when the user operates an unillustrated operation panel to shift this state to a monochromatic transfer mode for outputting a monochromatic (black and white) image, driving force is transmitted from a driving source to the rod 116 according to instructions from an unillustrated controller. By transmission of the driving force, the rod 116 is rotated to turn the cam members 126 180 degrees.

As illustrated in FIGS. 3 and 7, when the cam members 126 turn 180 degrees, the outer peripheral surfaces of the cam members 126 press the contact faces 124, the long diameter sides of the cam members 126 come into contact with the contact faces 124, and the first moving members 112 move toward the tensioning roller 40 in the first direction.

When the first moving members 112 move in the first direction, pressing force is transmitted to the support members 84 and the support members 72 via the projections 122 and the projections 120 provided on the first moving members 112. Then, the support members 84 and the support members 72 turn about the turn shaft 86 and the turn shafts 74, respectively, and the regulation roller 82 and the first transfer rollers 34Y, 34M, and 34C are placed at a second position withdrawn from the intermediate transfer belt 32.

By outputting an image in this state, a monochromatic image is formed on a sheet material P.

Figure 8:
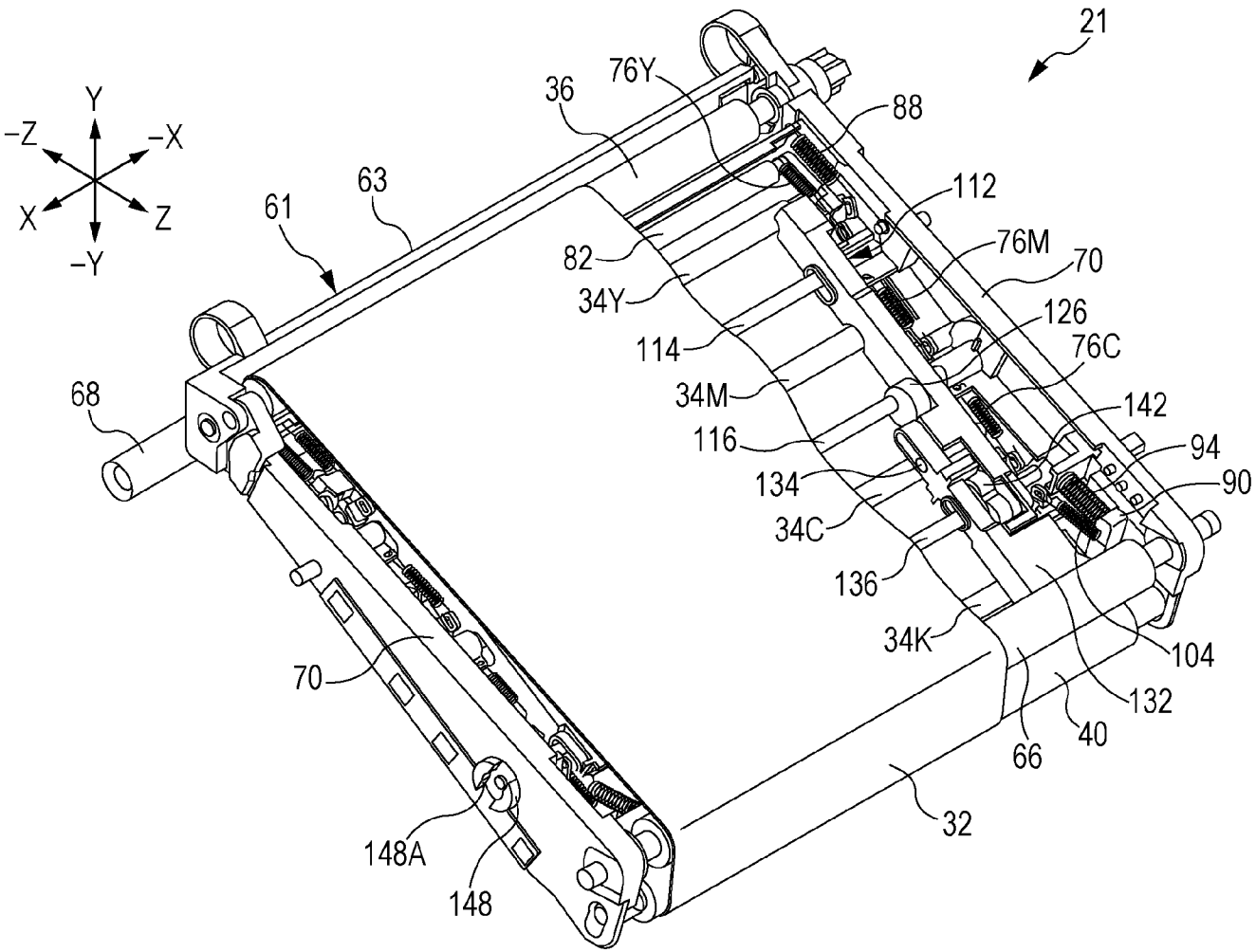
FIG. 8 is a perspective view of the first transfer unit.

Further, in this state (monochromatic transfer mode), when the operator (user) opens the cover 270 and turns the handle 230 (in reverse) from a contact turn position (see FIG. 25) to a separate turn position (see FIG. 26), the cam members 142 turn 90 degrees, as illustrated in FIGS. 4 and 8. When the cam members 142 turn 90 degrees, the outer peripheral surfaces of the cam members 142 press the contact faces 140, the long diameter sides of the cam members 142 come into contact with the contact faces 140, and the second moving members 132 move toward the driving roller 36 in the first direction.

When the second moving members 132 move in the first direction, pressing force is transmitted to the support members 98 and the holding members 90 via the projections 146 and the projections 138 provided on the second moving members 132. Then, the support members 98 turn about the turn shaft 102, the first transfer roller 34K is placed at a fourth position, and the holding members 90 turn about the turn shaft 92, so that tension applied to the intermediate transfer belt 32 is released. As a result, the intermediate transfer belt 32 separates from the image carrier 18.

In this way, the multicolor transfer mode is shifted to the monochromatic mode, and further, the monochromatic transfer mode is shifted to a withdrawal mode in which all the first transfer rollers 34 are withdrawn from the intermediate transfer belt 32.

Figure 9:
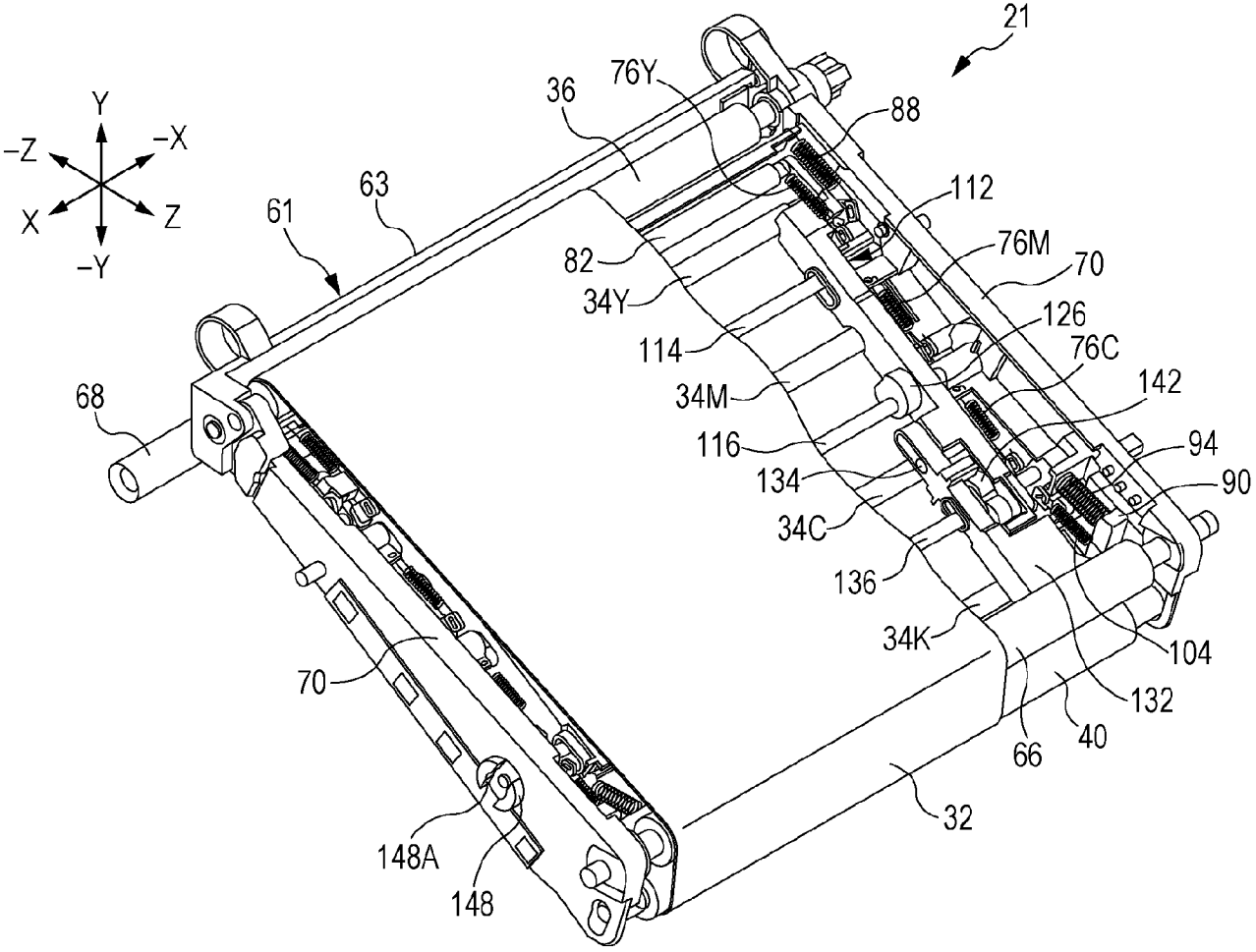
FIG. 9 is a perspective view of the first transfer unit.

In contrast, when the operator (user) opens the cover 270 and turns the handle 230 (in reverse) from the contact turn position (see FIG. 25) to the separate turn position (see FIG. 26) in the multicolor transfer mode, the cam members 142 turn 90 degrees, as illustrated in FIGS. 5 and 9. When the cam members 142 turn 90 degrees, the outer peripheral surfaces of the cam members 142 press the contact faces 140, the long diameter sides of the cam members 142 come into contact with the contact faces 140, and the second moving members 132 move toward the driving roller 36 in the first direction.

When the second moving members 132 move in the first direction, pressing force is transmitted to the support members 98 and the holding members 90 via the projections 146 and the projections 138 provided on the second moving members 132. Then, the support members 98 turn about the turn shaft 102, the first transfer roller 34K is placed at a fourth position, and the holding members 90 turn about the turn shaft 92, so that tension applied to the intermediate transfer belt 32 is released.

Further, when the cam members 142 turn 90 degrees, the outer peripheral surfaces of the cam members 142 press the contact faces 144, the long diameter sides of the cam members 142 come into contact with the contact faces 144, and the first moving members 112 move toward the tensioning roller 40 in the first direction.

When the first moving members 112 move in the first direction, pressing force is transmitted to the support members 84 and the support members 72 via the projections 122 and the projections 120 provided on the first moving members 112. Then, the support members 84 and the support members 72 turn about the turn shaft 86 and the turn shafts 74, respectively, and the regulation roller 82 and the first transfer rollers 34Y, 34M, and 34C are placed at a second position withdrawn from the intermediate transfer belt 32. As a result, the intermediate transfer belt 32 separates from the image carriers 18.

In this way, the multicolor transfer mode is directly shifted to the withdrawal mode.

As illustrated in FIG. 1, in the state in which a shift to the withdrawal mode is made, the first transfer unit 21 is demounted from the apparatus body 10A. To mount the first transfer unit 21 in the apparatus body 10A, a procedure reverse to the above-described procedure is performed. Specific operations of mounting and demounting the first transfer unit 21 in and from the apparatus body 10A will be described below.

As described above, the first switch mechanisms 110 and the second switch mechanisms 130 allow the first transfer rollers 34 to directly shift from both the multicolor transfer mode and the monochromatic transfer mode to the withdrawal mode.

When the first transfer rollers 34 shift to the withdrawal mode, the tension applied to the intermediate transfer belt 32 by the tensioning roller 40 is released. Hence, curling of the intermediate transfer belt 32 is suppressed, and the life of the intermediate transfer belt 32 is lengthened.

The regulation roller 82 withdraws from the back surface of the intermediate transfer belt 32 in association with the switch of the first switch mechanisms 110 from the multicolor transfer mode to the monochromatic transfer mode or the switch of the second switch mechanisms 130 from the multicolor transfer mode to the withdrawal mode. Hence, damage to the back surface of the intermediate transfer belt 32 is suppressed.

Mounting and Demounting Operations of First Transfer Unit 21

Next, mounting and demounting operations of the first transfer unit 21 will be described.

To demount the first transfer unit 21 from the apparatus body 10A, first, the cover 270 is opened to open the X-direction side of the apparatus body 10A.

Next, the operator (user) turns the handle 230 (in reverse) from a contact turn position (see FIG. 25) to a separate turn position (see FIG. 26). Thus, the body side coupling 210 turns from the contact turn position to the separate turn position, any of a multicolor transfer mode and a monochromatic transfer mode shifts to a withdrawal mode, and the intermediate transfer belt 32 separates from the image carriers 18, as described above. Further, the restricting portion 238 of the handle 230 withdraws from the restricted portion 264 of the toner bottle 260, so that detachment of the toner bottle 260 is allowed.

Next, the operator (user) moves the toner bottle 260 in the X-direction and detaches the toner bottle 260 from the apparatus body 10A. Thus, the discharge pipes 68 of the first transfer unit 21 are drawn out from the insertion holes 269 of the toner bottle 260. Further, the body side coupling 210 is moved to a withdrawal position by the biasing force of the compression spring 204, and is decoupled from the transfer-unit side coupling 148.

The top of the apparatus body 10A is opened by opening the cover portion 150, and the first transfer unit 21 is demounted from the apparatus body 10A obliquely upward to the left in FIG. 1.

In this way, in the exemplary embodiment, the body side coupling 210 withdraws from the transfer-unit side coupling 148 when the intermediate transfer belt 32 is detached from the apparatus body 10A. Hence, interference between the body side coupling 210 and the transfer-unit side coupling 148 is suppressed. Further, since the discharge pipes 68 are drawn out from the insertion holes 269 of the toner bottle 260, interference between the discharge pipes 68 and the toner bottle 260 is suppressed.

To mount the first transfer unit 21 in the apparatus body 10A, first, the operator (user) inserts the first transfer unit 21 obliquely downward to the right in FIG. 1 through the open top of the apparatus body 10A.

Next, the operator (user) attaches the toner bottle 260 to the apparatus body 10A in the −X-direction. Thus, the discharge pipes 68 of the first transfer unit 21 are inserted in the insertion holes 269 of the toner bottle 260. Also, the body side coupling 210 is moved to a coupled position against the biasing force of the compression spring 204, and is coupled to the transfer-unit side coupling 148. That is, in a state in which the toner bottle 260 is not attached to the apparatus body 10A, the body side coupling 210 and the transfer-unit side coupling 148 are not coupled, and therefore, the rod 136 does not rotate, and the intermediate transfer belt 32 does not erroneously touch the image carriers 18.

Since the body side coupling 210 and the transfer-unit side coupling 148 are coupled by attachment of the toner bottle 260, an operation of coupling the body side coupling 210 and the transfer-unit side coupling 148 is not performed separately from the operation of attaching the toner bottle 260.

At the withdrawal position, the body side coupling 210 is in contact with the restricted face 218C, and is not erroneously turned to a contact turn position.

Next, the operator (user) turns the handle 230 (forward) from a separate turn position (see FIG. 26) to a contact turn position (see FIG. 25). Thus, the body side coupling 210 turns from the separate turn position to the contact turn position, and the intermediate transfer belt 32 comes into contact with the image carriers 18. Further, the restricting portion 238 of the handle 230 covers the restricted portion 264 of the toner bottle 260 in the X-direction, so that the toner bottle 260 is restricted in movement in the X-direction, and is prohibited from being detached. Therefore, the toner bottle 260 is not erroneously detached from the apparatus body 10A in the state in which the intermediate transfer belt 32 is in contact with the image carriers 18.

Finally, the cover 270 is closed to close the X-direction side of the apparatus body 10A. In the exemplary embodiment, when the handle 230 is at the separate turn position, the cover 270 is not closed because the rib 272 is in contact with the handle 230. Therefore, the cover 270 is not erroneously closed in the state in which the intermediate transfer belt 32 is separate from the image carriers 18.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. For example, while the first transfer roller 34K for black is in contact with the intermediate transfer belt 32 in the monochromatic transfer mode in the above-described exemplary embodiment, the first transfer roller for another color, such as magenta, may be in contact with the intermediate transfer belt 32. Further, while the image forming apparatus adopts electrophotography in the exemplary embodiment of the present invention, it may adopt other methods, for example, an inkjet method.

What is claimed is:

1. An image forming apparatus comprising:

an image carrier rotatably provided in an apparatus body to carry an image;

a transfer body on which the image carried by the image carrier is transferred, the transfer body being provided in the apparatus body such as to be detachable in an orthogonal direction orthogonal to a rotation axis direction of the image carrier;

a contact and separation mechanism provided in the transfer body to move the transfer body into contact with and away from the image carrier;

a coupling member provided in the apparatus body to be coupled to the contact and separation mechanism in the rotation axis direction of the image carrier, a biasing member provided in the apparatus body to bias the coupling member in the opposite direction at the second turn position; and a container removably attached to the apparatus body to receive developer removed from the transfer body, wherein, when the coupling member is turned forward to a first turn position in a coupled state coupled to the contact and separation mechanism, the contact and separation mechanism brings the transfer body into contact with the image carrier, and when the coupling member is turned in reverse from the first turn position to a second turn position in the coupled state, the contact and separation mechanism separates the transfer body from the image carrier and the coupling member is withdrawn at the second turn position in an opposite direction opposite a coupling direction in which the coupling member is coupled to the contact and separation mechanism so as to allow detachment of the transfer body, and when the container is attached to the apparatus body, the coupling member is pressed against biasing force of the biasing member to a position coupled to the contact and separation mechanism from a withdrawal position withdrawn from the contact and separation mechanism at the second turn position.

2. The image forming apparatus according to claim 1, wherein the coupling member is restricted in turn to the first turn position in a state withdrawn in the opposite direction at the second turn position.

3. The image forming apparatus according to claim 1, further comprising:

an operating portion provided in the coupling member to turn the coupling member forward and in reverse; and a restricting portion provided in the operating portion to restrict the container in movement in a detachment direction when the coupling member is turned to the first turn position in a state in which the container is attached to the apparatus body.

4. The image forming apparatus according to claim 1, further comprising:

an opening and closing portion openably and closably provided in the apparatus body to cover the container attached to the apparatus body, the opening and closing portion being restricted in closing relative to the apparatus body when the coupling member is located at the second turn position.

5. The image forming apparatus according to claim 3, further comprising:

an opening and closing portion openably and closably provided in the apparatus body to cover the container attached to the apparatus body, the opening and closing portion being restricted in closing relative to the apparatus body when the coupling member is located at the second turn position.

* * * * *